US005319424A

United States Patent [19]

Tomiyama et al.

[11] Patent Number: 5,319,424

[45] Date of Patent: Jun. 7, 1994

[54] DEVELOPER FOR DEVELOPING ELECTROSTATIC IMAGE, IMAGE FORMING METHOD, ELECTROPHOTOGRAPHIC APPARATUS, APPARATUS UNIT, AND FACSIMILE APPARATUS

[75] Inventors: Koichi Tomiyama, Kawasaki; Masayoshi Kato, Iruma; Tsutomu Kukimoto; Hiroshi Yusa, both of Yokohama; Kiyoko Tsuchiya, Yokosuka, all of Japan

[73] Assignee: Canon Kabushiki Kaisha Tokyo, Japan

[21] Appl. No.: 118,720

[22] Filed: Sep. 10, 1993

Related U.S. Application Data

[62] Division of Ser. No. 783,185, Oct. 28, 1991, Pat. No. 5,270,143.

[30] Foreign Application Priority Data

| | | | |
|---|---|---|---|
| Oct. 26, 1990 | [JP] | Japan | 2-287158 |
| Mar. 1, 1991 | [JP] | Japan | 3-036165 |
| Mar. 1, 1991 | [JP] | Japan | 3-036166 |
| Mar. 1, 1991 | [JP] | Japan | 3-036180 |

[51] Int. Cl.[5] ..... G03G 15/14; G03G 15/02

[52] U.S. Cl. ..... 355/273; 355/210; 355/219; 355/221; 355/271; 355/274; 430/109; 430/111; 430/126

[58] Field of Search ..... 430/109, 110, 111, 903, 430/126; 355/219, 221, 222, 200, 210, 296, 273, 271, 274; 358/296

[56] References Cited

U.S. PATENT DOCUMENTS

| | | | |
|---|---|---|---|
| 4,702,986 | 10/1987 | Imai et al. | 430/120 |
| 4,816,365 | 3/1989 | Ishikawa | 430/111 |
| 4,885,222 | 10/1989 | Kaneko et al. | 430/111 X |
| 4,891,294 | 1/1990 | Noguchi | 430/903 |
| 4,937,633 | 6/1990 | Ewing | 355/299 |
| 4,939,060 | 7/1990 | Tomiyama et al. | 430/106.6 |
| 4,943,505 | 7/1990 | Aoki et al. | 430/109 |
| 4,967,231 | 10/1990 | Hosoya et al. | 355/219 |
| 4,973,541 | 11/1990 | Kohri et al. | 430/111 |
| 5,024,915 | 6/1991 | Sato et al. | 430/110 |
| 5,041,351 | 8/1991 | Kitamori et al. | 430/106.6 |
| 5,075,158 | 12/1991 | Kouno et al. | 430/110 X |
| 5,077,169 | 12/1991 | Inoue et al. | 430/111 |
| 5,139,914 | 8/1992 | Tomiyama et al. | 430/109 X |
| 5,164,779 | 11/1992 | Araya et al. | 355/219 |
| 5,182,604 | 1/1993 | Asai | 355/219 X |
| 5,223,365 | 6/1993 | Yamamoto et al. | 430/111 X |
| 5,229,818 | 7/1993 | Nakahara et al. | 355/222 |
| 5,235,386 | 8/1993 | Yano et al. | 355/219 |
| 5,253,017 | 10/1993 | Takeda | 355/219 |

FOREIGN PATENT DOCUMENTS

| | | |
|---|---|---|
| 207628 | 1/1987 | European Pat. Off. . |
| 355676 | 10/1989 | European Pat. Off. . |
| 410483 | 1/1991 | European Pat. Off. . |
| 2611281 | 8/1988 | France . |
| 46-5782 | 12/1971 | Japan . |
| 48-47345 | 7/1973 | Japan . |
| 48-47346 | 7/1973 | Japan . |
| 49-6523 | 1/1974 | Japan . |
| 50-27546 | 3/1975 | Japan . |
| 50-13661 | 5/1975 | Japan . |
| 60-186854 | 9/1985 | Japan . |
| 1-112253 | 4/1989 | Japan . |
| 1-113762 | 5/1989 | Japan . |
| 1-121861 | 5/1989 | Japan . |
| 2-284158 | 11/1990 | Japan . |

*Primary Examiner*—Matthew S. Smith

*Attorney, Agent, or Firm*—Fitzpatrick, Cella, Harper & Scinto

[57] ABSTRACT

A developer for developing an electrostatic image has a toner, fine resin particles with a surface shape sphericity $\psi$ of from 0.90 to 0.50, and fine inorganic particles.

87 Claims, 11 Drawing Sheets

DEVELOPER FOR DEVELOPING ELECTROSTATIC IMAGE, IMAGE FORMING METHOD, ELECTROPHOTOGRAPHIC APPARATUS, APPARATUS UNIT, AND FACSIMILE APPARATUS

This application is a division of application Ser. No. 07/783,185 filed Oct. 28, 1991, now U.S. Pat. No. 5,270,143.

BACKGROUND OF THE INVENTION

1. Field of the Invention

The present invention relates to a developer for developing an electrostatic image that is used for converting an electrostatic latent image to a visible image in image forming processes such as electrophotography, electrostatic recording and eIectrostatic printing. It also relates to an image forming method, an electrophotographic apparatus, an apparatus unit and a facsimile apparatus that make use of the developer.

More particularly, the present invention relates to a developer for developing an electrostatic image, that is used in electrophotographic processes comprising a charging step of bringing a charging member to which a voltage has been externally applied, into contact with an electrostatic image bearing member to effect electrostatic charging, and a developing step of developing an electrostatic image by using a developer; and an image forming method, an electrophotographic apparatus, an apparatus unit and a facsimile apparatus that make use of the developer.

2. Related Background Art

Corona dischargers are hitherto known as charging means in electrophotographic apparatus and so forth. The corna dischargers, however, have the problems that a high voltage must be applied thereto and ozone is produced in a large quantity.

It is recently studied to omit a cornea discharger and to use a contact charging means. Stated specifically, this is a means in which a voltage is applied to a conductive roller serving as a charging member, and then the roller is brought into contact with a photosensitive member which is a member being charged, so that the surface of the photosensitive member is electrostatically charged to a given potential. Use of such a contact charging means makes it possible to apply a lower voltage than the use of the corona dischargers and to decrease the generation of ozone.

For example, Japanese Patent Publication No. 50-13661 proposes to use a roller comprising a mandrel covered with a dielectric material such as nylon or polyurethane rubber so that a photosensitive sheet can be electrostatically charged at a low voltage.

The roller comprising a mandrel covered with nylon, however, has no elasticity such as rubber, and hence the roller can not be kept in sufficient contact with the member being charged, so that faulty charging tends to occur: On the other hand, covering the mandrel with polyurethane rubber may cause exudation of a softening agent with which the polyurethane rubber is impregnated, and has involved the problem that, when a photosensitive member is used as the member being charged, the roller tends to stick to the photosensitive member at the former's portion coming into contact with the latter then the photosensitive member is stopped, or that the region for corresponding to the part where both had been stuck in contact causes unfocused images. Once the softening event in the rubber material of the roller has exuded and stuck to the surface of the photosensitive member, the photosensitive member exhibits a low resistivity to cause smeared images (i.e., a leak of charges of an electrostatic image, on the surface of the photosensitive member) In extreme instances either, it becomes impossible to use the apparatus or the toner remaining on the surface of the photosensitive member then sticks to the roller surface to cause a filming phenomenon. In the event that the toner has stuck to the roller surface in a large quantity, the roller surface turns insulative, resulting in a loss of the charging ability of the roller and a non-uniform charge on the surface of the photosensitive member, which adversely affects images.

This is due to the fact that the charging member (the roller) strongly presses the developer against the surface of the photosensitive member and hence the remaining developer sticks to the charging member or the surface of the member being charged and also the surface of the charging member and the surface of the member being charged tend to be damaged or scraped.

In the contact charging means, a direct current or a direct current overlaid with an alternating current is applied to the charging member. In such an instance, abnormal charge or flying movement of the remaining developer particularly having a small particle diameter and a light-weight is repeated in the surrounding area of the part at which the charging member and a photosensitive drum come into contact each other. Hence, this area is in such a state that the remaining developer is electrostatically attracted to, or embedded in, the surface of the charging member or photosensitive drum. This is quite different from the case where a noncontact charging means comprised of the conventional corona discharger is used.

Meanwhile, in recent years, copiers, laser printers, etc. which are small-sized, inexpensive and of personal use have come into use. In these small-sized machines, a cartridge system in which a photosensitive member, a developing device and a cleaning device are assembled into a unit is used from the standpoint of making them free from maintenance, and it is desired to use as the developer a one-component magnetic developer since &he structure of a developing assembly can be simplified.

In order to form a visible image with a good image quality in the method making use of such a one-component magnetic developer, the developer must have a high fluidity and a uniform chargeability. For this purpose, a fine inorganic powder has been hithereto added and mixed to a toner powder. It has been proposed to use as the fine inorganic powder a fine silica powder having been subjected to hydrophobic treatment, as disclosed in Japanese Patent Applications Laid-open No. 46-5782, No. 48-47345, No. 48-47346, etc. For example, a treated fine silica powder is used which is obtained by reacting a fine silica powder with an organic silicon compound such as dimethyldichlorosilane to substitute silanol groups on the particle surfaces of the fine silica powder with organic groups so that the powder is made hydrophobic.

The developer having such a fine inorganic powder, however, tends to cause scratches particularly on the contact charging member and photosensitive member and to cause melt adhesion or filming of the toner to the contact charging member and photosensitive member, in an image forming step at which the developer is pressed against the photosensitive member by contact charging. In an extreme instance, faulty images tend to be formed.

With regard to addition of fine resin particles to a developer, Japanese Patent Application Laid-open No. 60-186854 proposes to add to a developer, spherical or substantially spherical polymer particles smaller than toner particles.

A developer prepared in the same manner as disclosed therein has been examined to reveal that the developer is less effective for preventing the melt adhesion of toner onto the photosensitive member and, in the apparatus making use of contact charging, the contact charging device is contaminated to tend to cause charge non-uniformity.

Japanese Patent Application Laid-open No. 1-121861 proposes a developer prepared by adding fine organic particles to toner particles containing an ionically cross-linked vinyl polymer as a binder resin. It is noted therein that this developer may preferably comprise spherical fine organic particles.

As methods of fixing a toner image, a contact heating method as typified by a heat roller fixing method is commonly used, and there is a demand for a toner capable of being fixed at a low temperature so that power consumption can be decreased. For this reason, it is proposed to incorporate a resin with a low-molecular component and a high-molecular component so that the low-temperature fixing performance and anti-offset properties can be improved.

When, however, a developer containing the binder resin in which the low-molecular component has been increased for the purpose of low-temperature fixing is used in an image forming apparatus having a contact charging device or a contact transfer means, the following problems tend to arise.

Presence of a large quantity of the low-molecular component in a binder resin brings about excess grindability of toner particles such that the toner particles tend to be broken to give ultrafine particles because of shear produced during preparation. In a developing device the, and the ultrafine particles slip through a cleaning member and adhere to the contact charging member or contact transfer means to tend to cause faulty charging or faulty transfer in an environment of low temperature and low humidity, and cause the melt adhesion of toner to the surface of the photosensitive member in an environment of high temperature and high humidity.

The ultrafine particles produced as a result of break up of toner particles have the same chargeabiity as the toner particles, and hence inhibit the charging of toner particles to cause a lowering of image density.

In the contact heating method, it is required for the toner to be properly softened and fixed at the heating temperature, and it is also required to prevent occurrence of what is called the offset phenomenon, which is a phenomenon in which part of softened toner adhers to a heating member and the adhered toner is transferred to a transfer sheet to contaminate an image. In order to better prevent this offset phenomenon, it is known &o incorporate toner particles with a polyolefin such as a low-molecular polyethylene or polypropylene, as disclosed in Japanese Patent Applications Laid-open No. 49-6523 and No. 50-27546.

Japanese Patent Application Laid-open No. 1-11376 proposes a developer comprising wax-containing toner particles mixed with fine resin particles smaller than the toner particles. It is noted therein that this developer may preferably comprise spherical fine organic particles.

When, however, such a developer comprising the toner containing a polyolefin is used in an image forming apparatus having the contact charging device, the following problems tend to arise.

The polyolefin has so poor a compatibility with the binder resin in the toner particles that a polyolefin having a larger disperse diameter tends to come a free polyolefin when toner is pulverized. Thus, the free polyolefin with a higher resistance, having been developed at an image portion or non-image portion, is transferred from an electrostatic image bearing member to a contact charging member to increase surface resistance, tending to cause faulty charging.

The free polyolefin has a high resistance and is negatively chargeable with respect to iron powder, and hence it makes fogging more serious because of the faulty charging in the case of a negatively chargeable developer and causes a poor fluidity in the case of a positively chargeable developer, tending to bring about blank areas in images and a non-uniformity in image density.

In the meantime, in recent years, with the wide spread of image forming apparatus such as electrophotographic copying machines, their uses have expanded in a great variety, and demands for their image quality have become severer. In the copying of images as in conventional documents and books, it is sought to reproduce images in a very fine and faithful state without causing any crushed line images or broken line images even during the copying of fine characters. In particular, in an instance in which a latent image formed on a photosensitive member provided in the image forming apparatus is a line image with a line width of 100 μm or less, the fine-line reproduction is commonly poor and no satisfactory sharpness of the line image has been achieved. Recently, in an image forming apparatus such as an electrophotographic printer making use of digital image signals, a latent image is formed of the assemblage of dots having a given potential, and its solid portion, half-tone portion and light portion are expressed according to changes in dot density. There, however, is a problem when the toner particles are not faithfully applied to the dots and hence the toner particles are not aligned with dots, that no gradation of the toner image can be obtained corresponding with the ratio of dot density at a black area to that of a white are a of the digital image. In the case when the resolution is improved by making dot size smaller, in order to improve image quality, it becomes more difficult to achieve the reproduction of a latent image formed of minute dots, tending to give an image having a poor resolution and gradation and also lacking sharpness.

For the purpose of improving image quality, several developers have been hitherto proposed.

Japanese Patent Applications Laid-open No. 1-112253 and No. 2-284158 propose a toner with a small particle diameter having a specific particle size distribution. The smaller particle diameter a toner has, the more uniformly charged the toner particle surfaces must be made. Hence, in order to achieve both a stable charge quantity and a superior fluidity, it is preferred to add as a charge control agent a dye or e derivative of the dye that can give a proper charge quantity when employed in small amounts.

On the hand, the smaller the particle diameter a toner has, the more it tends to release a free charge control agent during the step of pulverization and the more it tends to cause the inhibition of fluidity or the contamination of members due to a developer. In particular, the charge non-uniformity tends to occur when a member coming into contact with a photosensitive member has been contaminated.

Japanese Patent Application Laid-open No. 1-113762 proposes a developer comprising a mixture of fine acrylic resin particles and toner particles containing a charge control agent. It is noted therein that this developer may preferably comprise spherical fine organic particles.

When, however, such a developer containing a dye or a derivative of the dye as a charge control agent is used in the image forming apparatus having the contact charging device, the following problems tend to arise.

Since the charge control agent of a dye type is soft and viscous, the charge control agent may be released from toner particles and transferred to the contact charging member, resulting in an increase in surface resistance, which tends to cause faulty charging or faulty transfer.

Since the released charge control agent has a high chargeability, it may inhibit the toner particles from being electrostatically charged and at the same time make their fluidity poor, tending to cause blank areas in images and an uneven image density.

SUMMARY OF THE INVENTION

An object of &he present invention is to provide a developer for developing an electrostatic image, that has solved the above problems involved in the prior art, and an image forming method, an electrophotographic apparatus, an apparatus unit and a facsimile apparatus which make use of such a developer.

Another object of the present invention is to provide a developer for developing an eleotrostatic image, that does not cause, or not tend to cause, the melt adhesion of toner to a photosensitive member.

Still another object of the present invention is to provide a developer for developing an electrostatic image, that does not cause charge non-uniformity even when copies are made on a large number of sheets, in an image forming method having the step of contact charging.

A further object of the present invention is to provide a developer for developing an electrostatic image, having a high fluidity and also a uniform chargeability.

A still further object of the present invention is to provide a developer for developing an eleotrostatic image, having a good fixing performance and also a good anti-offset when heat roller fixing is carried out.

A still further object of the present invention is to provide a developer for developing an electrostatic image, that can achieve a high image density and that causes no fogging and no filming onto a photosensitive member, and an image forming method, an electrophotographic apparatus, an apparatus unit and a facsimile apparatus which make use of such a developer.

A still further object of the present invention is to provide a developer for developing an electrostatic image, that can be free from contamination of a contact charging member when a developing system in which an electrostatic image bearing member is electrostatically charged using a contact charging member is used, and hence is free from the occurrence of faulty charging because of no increase in surface resistance; and an image forming method, an electrophotographic apparatus, an apparatus unit and a facsimile apparatus which make use of such a developer.

A still further object of the present invention is to provide a developer for developing an electrostatic image, that can achieve good charging of toner partilces, can maintain fluidity and well and cause neither a blank area in images by poor development nor image density non-uniformity; and an image forming method, an electrophotographic apparatus, an apparatus unit and a facsimile apparatus which make use of such a developer.

A still further object of the present invention is to provide a developer for developing an electrostatic image, that does not tend to form ultrafine particles, does not tend to cause adhesion of such ultrafine particles even when a developing system in which an electrostatic image bearing member is electrostatically charged using a contact charging member, and hence does not tend to cause faulty charging in an environment of low temperature and low humidity and not tend to cause melt adhesion of toner to the surface of a electrostatic image bearing member in an environment of high temperature and high humidity; and an image forming method, an electrophotographic apparatus, an apparatus unit and a facsimile apparatus which make use of such a developer.

A still further object of the present invention is to provide a developer for developing an electrostatic image, that does not tend to from ultrafine particles, and hence does not inhibit charging of toner particles and can yield stable image density; and an image forming method, an electrophotographic apparatus, an apparatus unit and a facsimile apparatus using such a developer.

A still further object of the present invention is to provide a developer for developing an electrostatic image, that causes no faulty charging even when a developing system in which an electrostatic image bearing member is electrostatically charged using a contact charging member is used, and prevented fogging from becoming more serious because of faulty charging in the case of a negatively chargeable developer and does not bring about the blank areas in images and non-uniformity in image density caused by poor fluidity, in the case of a positively chargeable developer; and end an image forming method, an electrophotographic apparatus, an apparatus unit and a fecsimile apparatus which make use of such a developer.

The present invention provides a developer for developing an electrostatic image, comprising a toner, fine resin particles with a surface shape sphericity $\psi$ of from 0.90 to 0.50, and fine inorganic particles.

The present invention also provides a method of forming an image by a process comprising the steps of;

bringing a charging member to which a voltage has been externally applied, into con&ac& wi&h an electrostatic image bearing member to effect electrostatic charging;

forming an electrostatic image on the charged electrostatic image bearing member;

developing the electrostatic image formed on said electrostatic image bearing member, using a developer to form a toner image: said developer comprising a toner, fine resin particles with a surface shape sphericity $\psi$ of from 0.90 to 0.50, and fine inorganic particles; and transferring the toner image formed on said electrostatic image bearing member to a transfer medium to form a transferred image.

The present invention also provides an electrophotographic apparatus comprising;

an electrostatic image bearing member;

a contact charging member to which a voltage is externally applied, which electrostatically charges said electrostatic image bearing member while being brought into contact with it;

an electrostatic image forming means for forming an electrostatic image on the charged electrostatic image bearing member;

a developing means for developing the electrostatic image thus formed; said developing means comprising a developer carrying member and a developer container that holds therein a developer; said developer comprising a toner, fine resin particles with a surface shape sphericity $\psi$ of from 0.90 to 0.50, and fine inorganic particles; and a transfer means for transferring the toner image formed on said electrostatic image bearing member to a transfer medium.

The present invention still also provides an apparatus unit comprising:

an electrostatic image bearing member;

a contact charging member to which a voltage is externally applied, which electrostatically charges said electrostatic image bearing member while being brought into contact with it; end a developing means for developing an electrostatic image thus formed; said developing means comprising a developer carrying member and a developer container that holds therein a developer; said developer comprising e toner, fine resin particles with a surface shape sphericity $\psi$ of from 0.90 to 0.50, and fine inorganic particles;

said contact charging member end said developing means being held as one unit together with said electrostatic image bearing member, and said unit forming a single unit detachably provided in the body of an electrophotographic apparatus.

The present invention further provides a facsimile apparatus comprising an electrophotographic apparatus and a receiver means for receiving image information from a remote terminal;

said electrophotographic apparatus comprising;

an electrostatic image bearing member:

a contact charging member to which a voltage is externally applied, which electrostatically charges said electrostatic image bearing member while being brought into contact with it;

an electrostatic image forming means for forming an electrostatic image on the charged electrostatic image bearing member;

a developing means for developing the electrostatic image thus formed; said developing means comprising a developer carrying member and a developer container that holds therein a developer; said developer comprising a toner, fine resin particles with a surface shape sphericity $\psi$ of from 0.90 to 0.50, and fine inorganic particles; and a transfer means for transferring the toner image formed on said electrostatic image bearing member to a transfer medium.

DESCRIPTION OF PREFERRED EMBODIMENTS

Figure 1:
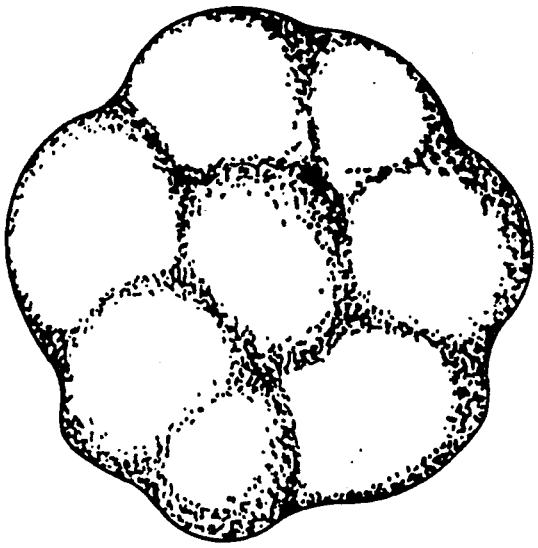
FIG. 1 is a schematic illustration of an example of the appearance of fine resin particles used in the present invention.

The reason why the fine resin particles are effective against the melt adhesion of toner to the electrostatic image bearing member such as a photosensitive member can be considered as follows:

A cause of the melt adhesion of toner to the photosensitive member is for one thing, the scratches produced when the surface of the photosensitive member is rubbed by a contact charging member to which fine inorganic powder has been adhered. In order to prevent the scratches from being produced, it is preferred to remove the free, fine inorganic powder from the parts which the contact charging member and the photosensitive member come into contact. This can be consequently effective for preventing the melt adhesion of toner to the photosensitive member. The fine resin particles with g a surface shape sphericity $\psi$ of from 0.90 to 0.50, used in the present invention each have an uneven or irregular surface to a certain extent as diagrammatically shown in FIG. 1, as compared with particles with the shape of true spheres, and hence they have the property of adsorbing on their surface a great number of particles of the fine inorganic powder present in a free state.

Figure 2:
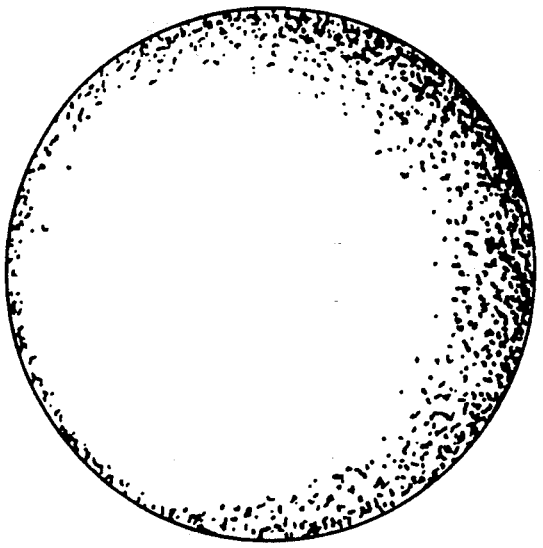
FIG. 2 is a schematic illustration of the appearance of a fine resin particle having a surface shape sphericity $\psi$ of about 1.

Spherical polymer particles obtained by emulsion polymerization or soap-free polymerization each have, as diagrammatically shown in FIG. 2, very little irregular surface, and hence the surface shape sphericity $\psi$ of the polymer particle is more than 0.90. In general, their surface shape sphericity $\psi$ is about 1.

Fine resin particles obtained from a bulk resin by mechanical pulverization or by pulverization using a jet stream have surfaces whose rupture cross-sections assume a great number of minute irregularities, and hence the surface shape sphericity of the fine resin particle is less than 0.50. In general, the surface shape sphericity $\psi$ of the fine resin particle is approximately from 0.3 to 0.4.

It is presumed that, in the image forming apparatus having a contact charging member, the fine resin particles having slipped through a cleaning blade are adsorbed to the contact charging member, and thereafter the fine resin particles present on the surface of the contact charging member adsorb the free, fine inorganic powder slipping through &he cleaning blade, so that the surface of the photosensitive member can be prevented from being damaged. Here, if the fine resin particles slipping through the cleaning blade are in a very large quantity, the free, fine inorganic powder becomes small in quantity and hence the melt adhesion of toner to the photosensitive member can be more effectively prevented, but on &he other hand a thick layer of the fine resin particles is formed on the contact charging member and hence this can be one of the causes of faulty charging of the photosensitive member. The fine resin particles used in the present invention each have an irregular surface to a certain extent as diagrammatically shown in FIG. 1, and hence they can be appropriately controlled as to the quantity of the particles slipping through the cleaning blade, compared with particles with the shape of true spheres, so that the faulty charging of the photosensitive member can be prevented from occurring.

If the surface shape sphericity $\psi$ of the fine resin particles is more than 0.90, the faulty charging of the photosensitive member may come to occur when copies are taken on a large number of sheets (e.g., 10,000 sheets or more). If the surface shape sphericity $\psi$ is less than 0.50, the fine resin particles may have a great number of irregularities on their surfaces to tend to increase moisture absorption and lower development performance of the developer in an environment of high temperature and high humidity. Moreover, the protruded portions on the surfaces of fine resin particles tend to be broken off on the occasion of their mixing with toner particles or in the course of development, so that a large number of fragments of the fine resin particles may become present in the developer to tend to adversely affect the development.

The fine resin particles used in the present invention may preferably have a primary average particle diameter of from 0.03 to 1.0 $\mu$m. It is more preferable to use those of from 0.05 to 0.8 $\mu$m. Particles with a primary average particle diameter larger than 1.0 $\mu$m have so small a specific surface area that they can not be suited for adsorption of the free, fine inorganic powder and can give only a small effect of preventing the melt adhesion of toner to the photosensitive member. On the other hand, those with a primary average particle diameter smaller than 0.03 $\mu$m may make the triboelectricity of the developer excessively high to tend to cause a lowering of density because of charge-up.

The fine resin particles may have a specific resistance of from $10^6$ to $10^{13}$ $\Omega$·cm, which can be preferably used. Use of those having a water-specific resistance lower than $10^6$ $\Omega$·cm tends to cause a lowering of the charge quantity of the developer, consequently tending to bring about a lowering of image density. Use of fine resin particles having a specific resistance higher than $10^{13}$ $\Omega$·cm tends to cause a lowering of the fluidity of the developer, and tends to give an image with much fogging.

The fine resin particles may preferably have a triboelectric charge quantity of not more than +50 $\mu$c/g in the case of positive charging, and not more than 200 $\mu$c/g as the absolute value in the case of negative charging. They many more preferably have a triboelectric charge quantity in the range of from +30 $\mu$c/g to −100 $\mu$c/g. If the triboelelctric charge quantity of the fine resin particles is higher than +50 $\mu$c/g, the triboelectricity of &he developer tends to become unstable, and fogging tends to occur when copies are taken on a large number of sheets. If the triboelectric charge quantity of the fine resin particles is smaller than −200 $\mu$c/g, the fluidity tends to become poor and density uneveness tends to occur on the image.

The fine resin particles should be used in an amount of from 0.01 to 1.0 part by weight, and preferably from 0.03 to 0.57 parts by weight based on 100 parts by weight of the toner. The fine inorganic powder such as hydrophobic fine silica powder may preferably be used in an amount of from 0.1 part by weight to 3.0 parts by weight based on 100 parts by weight of the toner. The fine inorganic powder may preferably be used in a larger amount than the fine resin particles.

Use of the fine resin particles in an amount more than 1.0 part by weight tends to cause a lowering of image density. On the other hand use thereof in an amount of less than 0.01 part by weight can be less effective against the melt adhesion of toner to the photosensitive member. Use of the fine resin particles in the same amount as, or in a larger amount than, that of the fine inorganic powder tends to make the fluidity of the developer poor and also tends to cause fogging.

The surface shape sphericity $\psi$ of the fine resin particles is defined as follows:

$$\psi = \frac{\text{Surface area (m}^2\text{/g) measured assuming fine resin particles as true spheres}}{\textit{BET}\text{ specific surface area (m}^2\text{/g) actually measured on fine resin particles}}$$

The BET specific surface area can be actually measured, when, for example, a specific surface area meter AUTOSORB-1, available from Quantachrome Co. is used, by the method as exemplified below.

About 0.3 g of fine resin particles are weighed and put in a cell, and deaeration is carried out at a temperature of 40° C. and a degree of vacuum of $1.0\times10^{-3}$ mmHg for at least 1 hour. Thereafter. nitrogen gas is adsorbed on the particles in the state they are cooled using liquid nitrogen, and the value is obtained by the multipoint method.

The surface area measured assuming the fine resin particles as true spheres can be determined, for example, in the following way: From particles in an electron microscope photograph (×10,000) of the fine resin particles, 100 fine resin particle images are collected at random, and their major axes are measured. A value obtained by averaging the measured major axes is regarded as a diameter (l) measured assuming the fine resin particles asture spheres. On the basis of the diameter (l), a radius $\tau$(i.e., ½ l) is determined and a surface area ($4\pi\tau^2$) of the fine resin particles is further determined. Then a volume ($4/3\ \pi^3$) of the fine resin particles is further obtained. The weight of the fine resin particles is determined from a density of the fine resin particles and the volume thus obtained. The surface area ($M^2$/g) measured assuming the fine resin particles as true spheres is determined from the surface area previously obtained and the weight thus obtained.

The triboelectric value of the fine resin particles used in the present invention can be measured by the following method: 0.2 g of the fine resin particles having been left for 12 hours or more in an environment of 23.5° C.

and 60% RH and 20.0 g of carrier iron powder whose particles are not coated with resin, having a main particle size at 200 to 300 meshes (e.g., EFV200/300, available from Nihon Teppun K. K.) are precisely weighed in the above environment, which are then thoroughly mixed in a wide-mouthed bottle with a stopper, made of polyethylene and having a volume of about 50 cc (the bottle is shaken up and down by hand about 125 times for 50 seconds).

Figure 10:
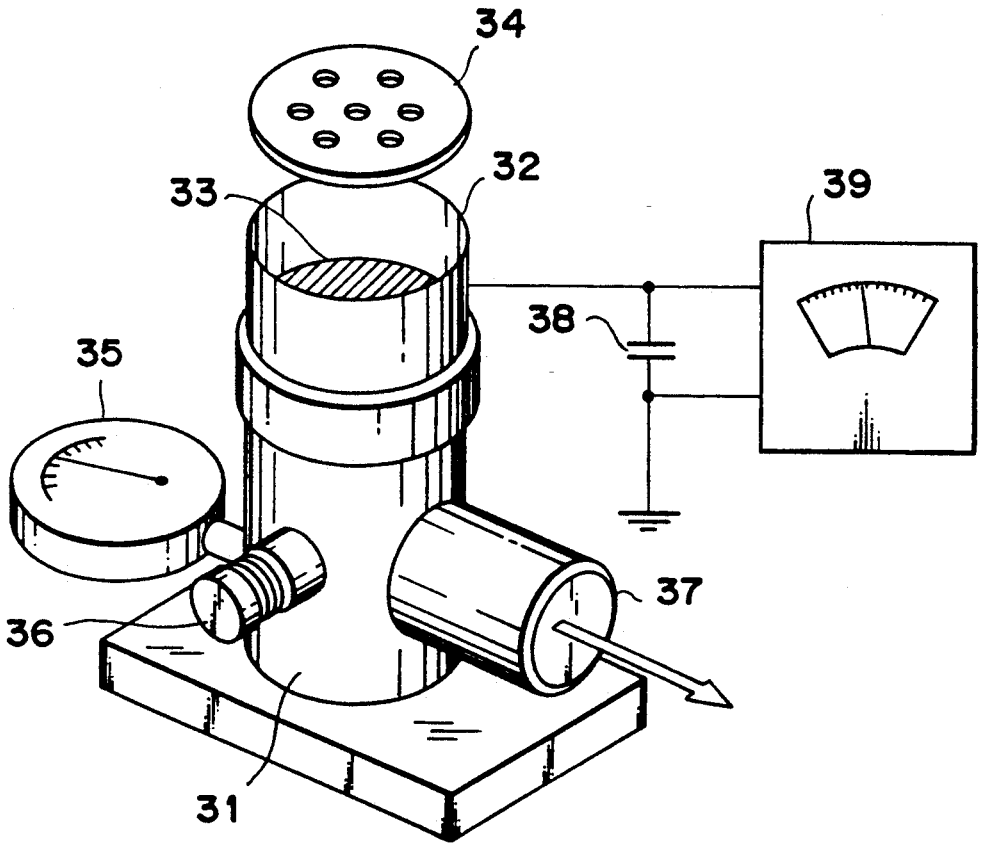
FIG. 10 is a schematic illustration of an apparatus for measuring the quantity of triboelectricity of a powder sample.

Next as shown in FIG. 10, about 2.0 g of the mixture is put in a measuring container 32 made of a metal at the bottom of which is provided a screen 33 of 400 meshes, end then the container is covered with a plate 34 made of a metal. The total weight of the measuring container 32 in this state is weighed and is expressed by $W_1$ (g). Next, in a suction device (made of an insulating material at least at the part coming into contact with the measuring container 32), air is sucked from a suction opening 37 and an air-flow control valve 36 is operated to control the pressure indicated by a vacuum indicator 35 to be 250 mmHg. In this state, suction is carried out for 5 minutes to remove the fine resin particles by suction. The potential indicated by a potentiometer 39 at this time is expressed by V (volt). The numeral 38 denotes a cepacitor, whose capacitance is expressed by C (μF). The total weight of &he measuring container after completion of the suction is also weighed and is expressed by $W_2$ (g). The quantity (μc/g) of triboelectricity of this fine resin particles is calculated as shown by the following equation.

$$\text{Quantity of triboelectricity} = \frac{C \times V}{W_1 - W_2}$$

Figure 11:
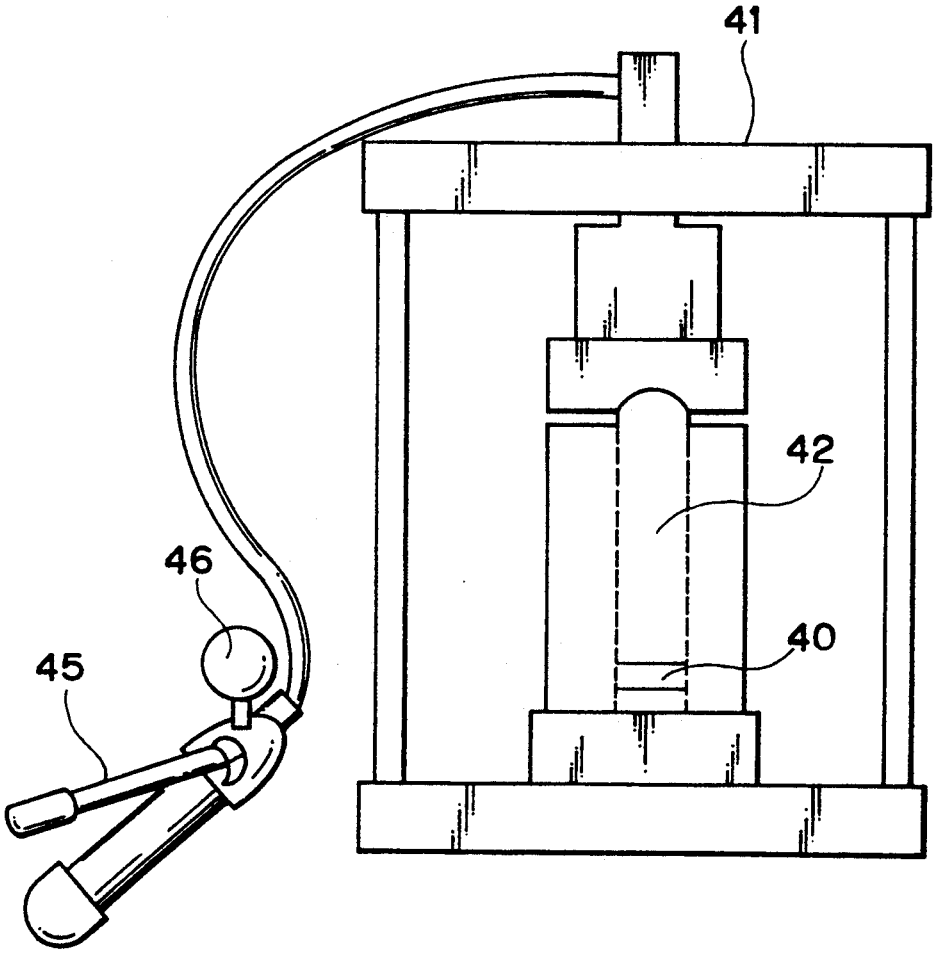
FIG. 11 is a schematic illustration of a molder for tableting a powder material.

The specific resistance (volume specific resistivity) referred to in the present invention can be measured, for example, in the following way: Using an apparatus shown in FIG. 11, the sample is molded into a tablet. First, about 0.3 g of a sample 40 is put in a tablet molding chamber 41. Next, a push bar 42 is inserted to the tablet molding chamber, and the sample is pressed by means of an oil pressure pump 45 at 250 kg/cm$^2$ for 5 minutes. Thus, a pellet-shaped tablet of about 13 mm in diameter and about 2 to 3 mm in height is molded. In the drawing, reference numberal 46 denotes a pressure gauge.

The tablet thus obtained is optionally coated with a conducting agent on its both sides, and the resistivity under application of a voltage of 1,000 V is measured in an environment of a temperature of 23.5° C. and a humidity of 65% RH, using, for example, 16008A RESISTIVITY CELL, available from Hewlett Packard Co., or 4329A HIGH RESISTANCE METER, available form Yokogawa Hewlett Pakard Co. A specific resistance ρ is determined from the following calculation.

$$\rho(\Omega\text{-cm}) = R(\Omega) \times S(cm^2)/l(cm)$$

wherein S is a sectional area of the sample, and l is a height of the sample.

The fine resin particles can be prepared by emulsion polymerization or spray drying. They may preferably be fine resin particles with a glass transition point of 80° C. or above, prepared by subjecting components used in binder resins or toner, such as styrene, acrlic acid, methlymethacrylate, butyl acrylate and 2-ethylhexyl acrylate, to copolymerization according to emulsion polymerization. Such fine resin particles can have a good effect.

The fine resin particles may be those cross-linked with a cross-linking agent such as divinylbenzene, and also their surfaces may be treated with a metal, a metal oxide, a pigment a dye or a surface active agent to make adjustment of specific resistance and triboelectric charge quantity.

The fine resin particles used in the present invention may particularly preferably be comprised of a block or random copolymer of a styrene type, containing 51% by weight or more of styrene monomers. Such styrene type fine resin particles are usually in the triboelectric series approximate to styrene-acrylate resins or polyester resins used in binder resins of developers, so that they can be less mutually electrified with respect to toner particles and their fluidity does not tend to become poor. Thus, styrene resins are preferred as the binder resin of the toner If the styrene monomers contained in the fine resin particles are less than 51% by weight, the developer may have strong agglomerating properties and poor fluidity, tending to cause blank areas in images and image density non-uniformity.

In the preparation methods such as emulsion polymerization, the styrene type fine resin particles have a tendency that the value ψ becomes smaller with an increase in the content of styrene monomers.

The styrene type fine resin particles with a surface shape sphericity ψ of from 0.90 to 0.50 according to the present invention can be obtained by controlling monomer composition, compositional ratios of monomers and polymerization conditions.

The fine inorganic powder used in the present invention can give good results when its particles have a specific surface area of from 70 to 300 m$^2$/g as measured by the BET method, utilizing nitrogen adsorption. The fine inorganic powder should be used in an amount of from 0.1 part by weight to 3.0 parts by weight, end preferably from 0.2 part by weight to 2.0 parts by weight, based on 100 parts by weight of the toner.

The fine inorganic powder may preferably be those having been subjected to hydrophobic treatment. They may particularly preferably be negatively chargeable, hydrophobic fine silica powder.

The fine inorganic powder used in the present invention may have a triboelectric charge quantity of from −100 μc/g to −300 μc/g, which can be preferably used. Powder with a triboelectric charge quantity less than −100 μc/g may lower the triboelectric charge quantity of the developer itself, tending to bring about a logering of humidity characteristics. Use of powder with a triboelectric charge quantity more than −300 μc/g may promote the developer carrying member memory, so that the developer carrying member tends to be affected by the deterioration of the fine inorganic powder, tending to have difficulties in durability. Powder finer than 300 m$^2$/g in specific surface area may give less effect of its addition to the developer, and powder coarser than 70 m$^2$/g may give a larger probability that it is present as a free matter, tending to cause black dots due to locallization of the fine inorganic powder or agglomerated matters.

The triboelectric value of the fine inorganic powder can be measured by the following method: 0.2 g of the fine inorganic powder having been left overnight in an environment of a temperature of 23.5° C. and a humidity 60% RH and 9.8 g of carrier iron powder whose particles are not coated with resin, having a main particle size at 200 to 300 meshes (e.g., EFV200/300, available from Nihon Teppun K.K.) are precisely weighed in the above environment, which are then thoroughly mixed in a wide-mouthed bottle with a stopper, made of polyethylene and having a volume of about 50 cc (the bottle is shaken by hand up and down about 50 times for about 20 seconds).

Next, the triboelectric charge quantity of the fine inorganic powder may be measured in the same way as in the measurement of the triboelectric charge quantity of the fine resin particles as previously described.

For the fine inorganic powder used in the present invention, it is particularly preferred to employ what is called dry silica, or dry silica called foged silica, produced by vapor phase oxidation of a silicon halide, and what is called get silica produced from water lass or the like, both of which can be used. In particular, the dry silica is preferred, which has less silanol groups present on the surfaces and the insides of the silica fine powder particles and may produce no residues in their manufacture, such as $Na_2O$ and $SO_3^{2-}$.

With the dry silica, other metal halides as exemplified by aluminum chloride or titanium chloride may be used together with the silicon halide in the manufacturing process so that a composite fine powder of silica with other metal oxide can be obtained. In the present invention, the fine inorganic powder includes such a powder.

The fine inorganic powder may preferably have a particle diameter ranging from 0.001 to 2 $\mu$ as the primary average parities diameter. It is particularly preferred to use fine silica powder having a primary average particle diameter ranging from 0.002 to 0.2 $\mu$.

The fine inorganic powder used in the present invention may preferably be hydrophobic.

The powder can be made hydrophobic using conventionally known hydrophobic treatments and methods. As the hydrophobic treatments, it is preferable to use silicon compounds having organosiloxane units, such as silicone oil or silicone varnish.

The silicone oil used in the treatment of the fine inorganic powder used in the present invention can be exemplified by a compound represented by the formula:

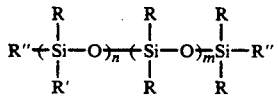

wherein R represents an alkyl group having 1 to 3 carbon atoms; R' represents a silicone oil modifying group such as an alkyl group, a halogen-modified alkyl group, a phenyl group or a modified phenyl group; and R'' represents an alkyl group or elkoxyl group having 1 to 3 carbon atoms. For example, the compound may include dimethylsilicone oil, alkyl-modified silicone oil, $\alpha$-methylstyrene-modified silicone oil, chlorophenylsilicone oil, fluorine-modified silicone oil. Examples of the silicone oil are by no means limited to these.

The above silicone oil may preferably be those having a viscosity of from 50 to 1,000 cSt at a temperature of 25° C. Silicone oil with a viscosity less than 50 cSt may be partially evaporated as a result of the application of heat, tending to cause a deterioration of charge characteristics. Those with a viscosity more than 1,000 cSt may become difficult to handle in the treatment. As methods for the silicone oil treatment, any known techniques can be used. For example, they include a method in which fine silica powder and silicone oil are mixed using a mixer; a method in which silicone oil is sprayed into fine silica powder by the use of a sprayer, and a method in which silicone oil is dissolved in a solvent and then fine silica powder is mixed in the solution. Examples of the treatment method are by no means limited to these.

As for the silicone varnish used for the treatment of the fine silica powder used in the present invention, any known material can be used.

For example, the silicone varnish may include KR-251 and KP-112, available from Shin-Etsu Silicone Co., Ltd. Examples of these are by no means limited to these.

As methods for the silicone varnish treatment, the same known techniques as in the silicone oil treatment can be used. The treated fine silica powder as described above (hereinafter "treated silica") can be effective when it is added in an amount of from 0.1 part by weight to 1.6 parts by weight based on 100 parts by weight of the toner. It can provide an excellent stability when added in an amount of from 0.3 part by weight to 1.6 parts by weight based on 100 parts by weight of the toner. Its addition in an amount less than 0.1 part by weight based on 100 parts by weight of the toner may give less effect of its addition, end addition in an amount more than 1.6 parts by weight tends to cause problems in development and fixing, which are thus not preferable.

Part of the silicon compound having an organosiloxane unit, which has treated the particle surfaces of the fine inorganic powder, is transferred onto the electrostatic Image bearing-member, and is effective for making easier the cleaning of powder such as free polyolefin.

To determine the hydrophobicity (the degree to which powder has been made hydrophobic) of the fine inorganic powder in the present invention, a value measured by the following method may be used. Of coarse, any other method for measurement can also be used while making reference to the method for measurement according to the present invention.

In a 200 ml separatory funnel with a stopper, 100 of ion-exchanged water and 0.1 g of a sample are introduced, followed by shaking for 10 minutes using a shaker (a tumbler shaker mixer, T2C-type) under conditions of 90 rpm. After the shaking, the mixture is left to stand for 10 minutes. After the inorganic powder layer and the aqueous layer have been separated, the lower layer, the aqueous layer, is collected in a quantity of 20 to 30 ml, which is then put in a 10 mm cell to measure its transmittance using light with a gavelength of 500 nm, on the basis of that of a blank, ion-exchanged water in which no fine silica powder is contained. The value of the transmittance is regarded as the hydrophobicity of the fine inorganic powder.

In the present invention, the hydrophobic fine inorganic powder may preferably have a hydrophobicity of not less then 60%, and more preferably not less than 90%. A hydrophobicity less than 60% makes it difficult to obtain images with a high quality level because of adsorption of greater to the fine inorganic powder in an environment of high humidity.

The developer may preferably contain the fine resin particles having a surface shape sphericity $\psi$ of from 0.90 to 0.50 and an average particle diameter of from 0.03 to 1.0 $\mu$m and the hydrophobic fine inorganic powder; said hydrophobic fine inorganic powder being contained in a larger quantity than the fine resin powder.

The toner according to &he present invention should have an average particle diameter of from 3.5 to 20 μm, preferably from 3.5 to 14 μm, and more preferably from 4 to 8 μm, as weight average particle diameter, and from 2.8 to 18 μm, preferably from 2.8 to 13 μm, and more preferably from 3 to 7 μm, as number average particle diameter.

In particular, a toner having a weight average particle diameter ($D_4$) of from 4 to 8 μm is preferred because of its excellent fine-line reproduction and resolution.

Particle size distribution of the toner can be measured by various methods. In the present invention, it is measured using a Coulter counter.

A Coulter counter Type TA-II (manufactured by Coulter Electronics, Inc.) is used as a measuring device. An interface (manufactured by Nikkaki k.k.) that outputs number distribution and volume distribution and e personal computer CX-1 (manufactured by Canon Inc.) are connected. As an electrolytic solution, an aqueous 1% NaCl solution is prepared using first-grade sodium chloride. Measurement is carried out by adding as a dispersant 0.1 ml to 5 ml of a surface active agent, preferably an alkylbenzene sulfonate, to 100 ml to 150 ml of the above aqueous electrolytic solution, and further adding 2 mg to 20 mg (as the number of particles about 30,000 to about 300,000 particles) of a sample to be measured. The electrolytic solution in which the sample has been suspended is subjected to dispersion for about 1 minute to about 3 minutes in an ultrasonic dispersion machine. The particle size distribution of particles with a size of from 2 to 40 μ is measured by means of the above Coulter counter Type TA-II using an aperture of 100 μ as its aperture. Then the value according to the present invention is determined.

The toner used in the developer of the present invention, when it has a negative triboelectricity, may preferably contain as a charge control agent an organic acid metal complex salt such as a salicylic acid metal complex salt, an alkylsalicylic acid metal complex salt, a dialkylsalicylic acid metal complex salt or a naphthoic acid metal complex salt, a dye such as a monoazo dye, and a monoazo dye derivative such as a metal complex salt of a monoazo dye.

The negative charge control agent comprising a dye compound may include azo type metal complex salts represented by the following Formula (I).

Formula (I)

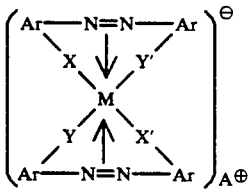

wherein M represents a coordination central metal, including Cr, Co, Ni, Mn and Fe having the coordination number of 6; Ar represents an aryl group, including a phenyl group and a naphthyl group, which may have a substitutent, which substituent may include a nitro group, a halogen atom, a carboxyl group, an anilide group and an alkyl group or alkoxyl group having 1 to 18 carbon atoms; X, X', Y and Y' each represent —O—, —CO—, —NH—or —NR—, where R represents an alkyl group having 1 to 4 carbon atoms; and A⊕ represents a hydrogen ion, a sodium ion, a potassium ion, an ammonium ion or an aliphatic ammonium ion.

Examples of the complex salt are shown below.

Complex (I)-1

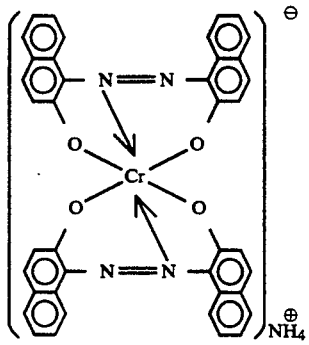

Complex (I)-2

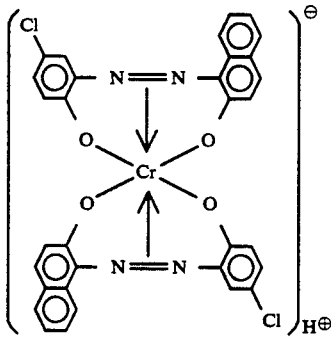

Complex (I)-3

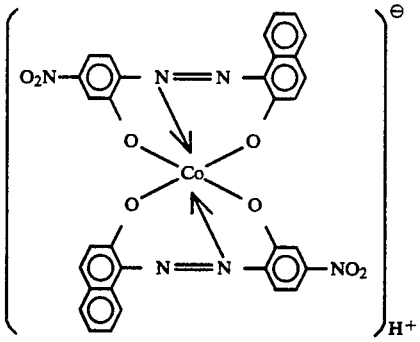

Complex (I)-4

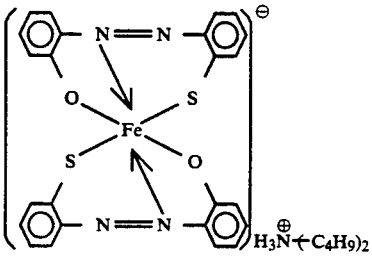

-continued

Complex (I)-5

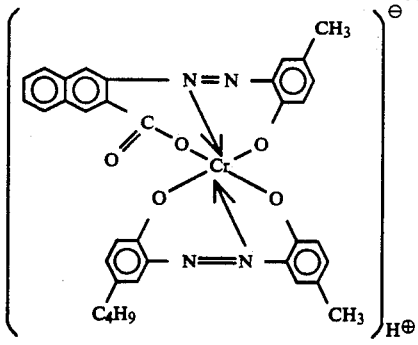

Complex (I)-6

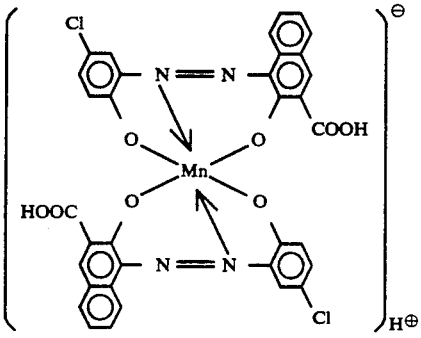

As for a positive charge control agent, it is possible to use, for example, a Nigrosine dye and a derivative thereof.

The charge control agent may preferably be contained in an amount of from 0.1 part by weight to 5 parts by weight, and particularly preferably from 0.2 part by weight to 3 parts by weight based on 100 parts by weight of the binder resin for the toner. Use of the charge control agent in an excessively large amount may make poor the fluidity of the toner, tending to cause fogging. On the other hand, use thereof in an excessively small amount may make it difficult to obtain a sufficient charge quantity.

As a preferred embodiment of the developer for developing can electrostatic image according to the present invention, it may include a developer for developing an electrostatic image, comprising i) a toner containing a charge control agent and having a weight average particle diameter ($D_4$) of from 4 to 8 μm, ii) styrene type fine organic particles having a smaller average particle diameter than said toner and having a surface shape sphericity ψ of from 0.90 to 0.50 and iii) fine inorganic particles having a smaller average particle diameter than said fine organic powder.

The binder resin for &he toner according to the present invention may include homopolymers of styrene or derivatives thereof such as polystyrene and polyvinyltoluene; styrene copolymers such as a styrene/propylene copolymer, a styrene/vinyltoluene copolymer, a styrene/vinylnaphthalene copolymer, a styrene/methyl acrylate copolymer, a styrene/ethyl acrylate copolymer, a styrene/butyl acrylate copolymer, a styrene/octyl acrylate copolymer, a styrene/dimethylaminoethyl acrylate copolymer, a styrene/methyl methacrylate copolymer, a styrene/ethyl methacrylate copolymer, a styrene/butyl methacrylate copolymer, a styrene/dimethylaminoethyl methacrylate copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer, a styrene/maleic acid copolymer and a styrene/maleate copolymer; polymethyl methacrylate, polybutyl methaorylate, polyvinyl acetate, polyethylene. polypropylene polyvinyl butyral, polyacrylic acid resin, rosin, modified rosin, terpene resin, phenol resin, aliphatic or alicyclic hydrocarbon resins, aromatic petroleum resins, pareffin wax, and carnauba wax. These may be used alone or in the form of a mixture.

The toner in the present invention, may preferably contain a binder resin containing not less than 15% of a component with a molecular weight of not more than 5,000 in molecular weight distribution as measured by gel permeation chromatography (GPC).

Figure 9:
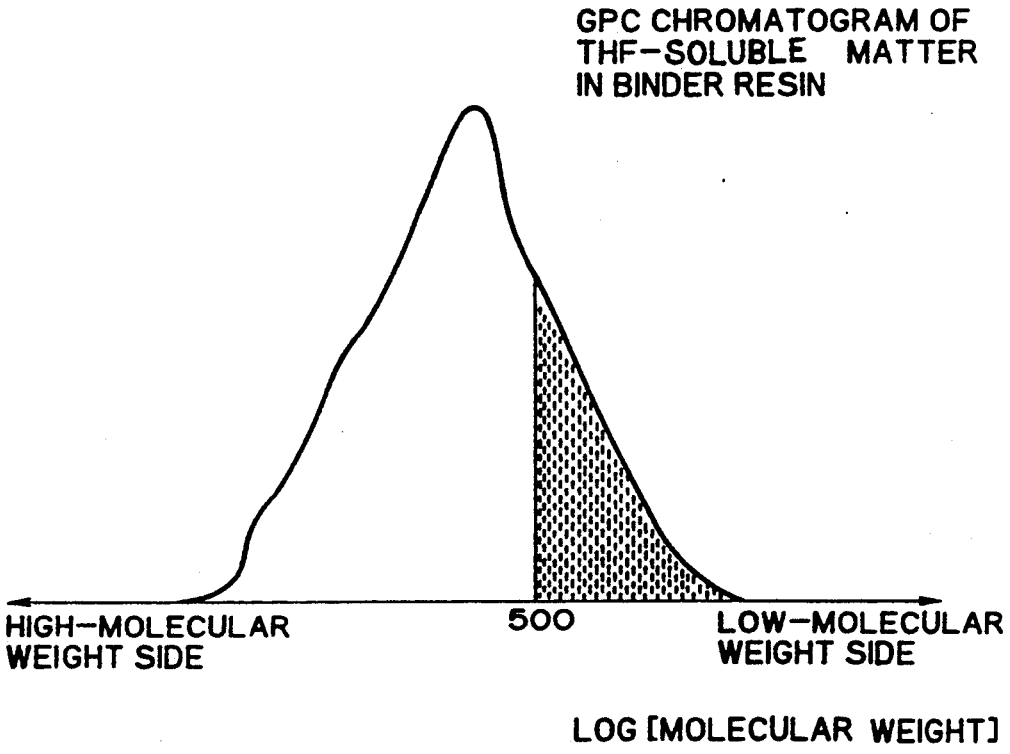
FIG. 9 shows a GPC chromatogram.

The content of the component with a molecular weight of not more than 5,000 in the binder resin is a numerical value calculated by determining area proportion of that component in a chromatogram showing molecular weight distribution in the measurement by GPC. Using the chromatogram showing molecular weight distribution in the measurement by GPC, as shown in FIG. 9, the area of the whole peak indicating the molecular weight distribution is determined and also the area of the region corresponding to the component with a molecular weight of not more than 5,000 is determined. On the basis of the two areas, the content of the component with a molecular weight of not more than 5,000 in the binder resin is calculated.

If the component with a molecular weight of not less than 5,000 is less than 15%, fixing performance tends become poor in heat fixing devices of a relatively low pressure as in small-sized machines as typified by desk top LBPs.

The component with a molecular weight of not more than 5,000 may more preferably be in an amount of less than 35%.

The component with a molecular weight of not more than 5,000 tends to exhibit molecular weight dependence of glass transition point (Tg) and hence the Tg of the toner, measured over a long period of time, is presumed to tend to become a little low. Thus, if the amount of this component is more than 35%, a thermal behavior not higher than the Tg usually measured may come to be exhibited to tend to cause the melt adhesion or filming.

This component can particularly improve the grindability of toners. If, however, its content is more than 35%, the grindability may become more than is necessary in the manufacture of toners having a weight average particle diameter of from 4 to 8 μm, resulting in an increase in the formation of ultrafine powder, which makes classification efficiency poor.

Moreover, the ultrafine powder having been not completely classified may gradually increase in its content with repetition of the supply of the toner, and may adhere to a toner triboelectricity-providing member such as a developing sleeve because of electrostatic force to impede triboelectric charging of the toner, tending to cause a poor development performance such as a low image density and fogging.

In the present invention, the molecular weight distribution on the chromatogram obtained by GPC (gel permeation chromatography) are measured under the following conditions.

Columns are stabilized in a heat chamber of 40° C. To the columns kept at this temperature, THF tetrahydrofuran) as a solvent is flowed at a flow rate of 1 ml per minute, and 10 μl of a THF sample solution is injected &hereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use for example, samples with molecular weights of approximately from $10^2$ to $10^7$, which are available from Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, 802, 803, 804, 805, 806, 807 and 800P, available from Showa Denko K. K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSKguard-column, available from Toso Co., Ltd.

The sample is prepared in the following way: A sample is put in THF, which is left to stand for several hours, followed by thorough shaking so that the sample is well mixed with THF (until the sample become free of coalescence), which is further left to stand for 12 hours or more. Here, the sample is so made as to be left in THF for 24 hours or more. Thereafter, the sample is passed through a sample treating filter (pore size: 0.45 to 0.5 μm: for example, Maishoridisk H-25-5, available from Toso Co., Ltd., or Ekikurodisk 25CR, available from German Science Japan Ltd, can be used), and &he resulting sample is used as the sample for GPC. Concentration of the sample is so controlled as to give a resin component of from 0.5 to 5 mg/ml.

The developer of the present invention may preferably comprise i) a toner containing the binder resin containing not less than 15% of a component with a molecular weight of not more than 5,000 in molecular weight distribution as measured by GPC, ii) styrene type fine organic powder having a smaller average particle diameter than said toner and iii) fine inorganic particles having a smaller average particle diameter than said fine organic particles; the surface shape sphericity ψ of said styrene type fine organic powder being in the range of from 0.90 to 0.50.

The developer of the present invention may preferably be a one-component magnetic developer comprising a magnetic toner containing a magnetic material in the toner particle. In this instance, the magnetic material serves also as a colorant. The magnetic material contained in the magnetic toner may include iron oxides such as magnetic, hematite and ferrite: and metals such as iron, cobalt and nickel, or alloys of any of these metals with a metal or metals such as aluminum, cobal, copper, lead, magnesium, tin, zinc, antimony, beryllium, bismuth, cadmium, calcium, manganese, selenium, titanium, tungsten and/or vanadium, and mixtures of any of these.

The magnetic material should preferably be a magnetic material having a BET surface specific area of from 1 to 20 $m^2/g$, and particularly preferably from 2.5 to 12 $m^2/g$, as measured by the nitrogen adsorption method. It may also preferably be a magnetic powder having a Mohs hardness of from 5 to 7. This magnetic powder should be contained in an amount of from 10 to 70% by weight based on the toner weight.

Any of these magnetic materials may preferably be those having an average particle diameter of from 0.1 to 2 μm, and more preferably from 0.1 to 0.5 μm, and should be contained in the toner in an amount of from 20 to 200 parts by weight based on 100 parts by weight of the resin component, and particularly preferably from 40 to 150 parts by weight based on 100 parts by weight of the resin component.

The magnetic material may preferably be those having a coercive force (Hc) of from 20 to 150 Oe, a saturation magnetization ($\sigma s$) of from 50 to 200 emu/g and a residual magnetization ($\sigma r$) of from 2 to 20 emu/g.

The colorant unable in the toner may include any suitable pigments or dyes.

The pigments may include, for example, carbon black, aniline black, acetylene black, Naphthol yellow, Hansa yellow, Rhodamine Lake alizarin Lake, red iron oxide, Phthalooyanine Blue and Indanthrene Blue. Any of these may be used in an amount large enough to maintain the optical density of fixed images. The pigment may preferably be used in an amount of from 0.1 part by weight to 20 parts by weight, and more preferably from 1 part by weight to 10 parts by weight, based on 100 parts by weight of the resin. The dyes may also be used for the same purpose. They may include, for example, azo dyes, anthrequinone dyes, xanthene dyes and methine dyes. The dye may preferably be used in an amount of from 0.1 part by weight to 20 parts by weight, and more preferably from 0.3 part by weight to 10 parts by weight, based on 100 parts by weight of the resin.

The one used in the present invention may preferably contain a wax in the toner particle.

The wax may include, for example, polyolefin waxes, solid paraffin wax, micro wax, rice wax, amide waxes, fatty acid waxes, fatty acid metal salt gases, partially saponified fatty acid ester waxes, silicone wax, higher alcohols, and carnauba wax. The wax may preferably be contained in an amount of from 0.5 part by weight to 20 parts by weight, and more preferably from 1 part by weight to 12 parts by weight, based on 100 parts by weight of the binder resin for the toner.

Wax in an excessively large content may result in an increase in free wax, making it impossible to prevent the problems of faulty cleaning, contamination of fixing rollers, a lowering of developing performance, etc., even in the developer containing the styrene type fine resin particles of the present invention. On the other hand, gas in an excessively small content may result in a lowering of fixing performance end anti-offset. The wax may preferably have a broad molecular weight distribution. From the viewpoint of improving cleaning performance of OPC photosensitive members, it may preferably be not less than 5, and more preferably from 5 to 10, in weight average molecular weight/number average molecular weight (Mg/Mn).

In the present invention, polyolefin gases are particularly preferred. Of these, polypropylene wax and polyethylene wax are preferred. Use of such wax enables achievement of better fixing performance, cleaning performance and developing performance.

As the olefin monomers constituting the polyolefin waxes, it is possible &o use, for example, ethylene, propylene, butene-1, pentene-1, hexene-1, heptene-1, octene- 1, nonene-1 and decene-1, or isomers of any of these, having unsaturated bonds at different positions, and also olefin monomers having branched chains comprising an alkyl group, such as 3-methyl-1-butene, 3-methyl-2-pentene and 3-propyl-5-methyl-2-hexene.

The molecular weight distribution of the wax according to the present invention can be measured, for example, in the following way.

Measurement conditions:

A. Apparatus: Waters Associates GPC-150C

B. Column: Shodex A-80M

C. Solvent: o-Dichlorobenzene (0.1 wt/vol % ionol added), 135° C., 1.0 ml/min

D. Preparation of sample:

Concentration: 0.1 wt/vol %

Solubility: Entirely soluble when used at high temperatures.

Filtration: None

E. Pour: 400 μl

F. Detector: RI (differential refractometer) 32×50%

G. Molecular weight calibration:

On the basis of monodisperse polystyrene molecular weight.

The developer of the present invention may preferably comprise i) a toner containing a wax with a weight average molecular weight/number average molecular weight (Mw/Mn) of not less than 5, ii) styrene type fine organic particles having a smaller average particle diameter than said toner, and iii) fine inorganic particles having a smaller average particle diameter than said styrene type fine organic particles; the surface shape sphericity $\psi$ of said styrene type fine organic powder being in the range of from 0.90 to 0.50.

To the developer of the present invention, other additives as exemplified by a lubricant such as Teflon or zinc stearate or, as a conductivity-providing agent, a metal oxide such as tin oxide may be added so long as the developer is substantially not adversely affected.

Methods for the preparation of the toner may include a method in which component& materials are well kneaded using a heat kneader such as a heat roll, a kneader or an extruder, followed by pulverization end classification to obtain the toner; a method in which other materials are dispersed in a binder resin solution, followed by spray drying to obtain the toner; and a method in which given materials are mixed in monomers that constitute the binder resin, to form an emulsified suspension, followed by polymerization to obtain the toner.

The developer of the present invention can be prepared by dry-mixing the toner, the organic fine resin particles and the fine inorganic powder by means of a mixing machine such as Henschel mixer.

A contact charging process that can be preferably used in the present invention will be specifically described below.

Figure 3:
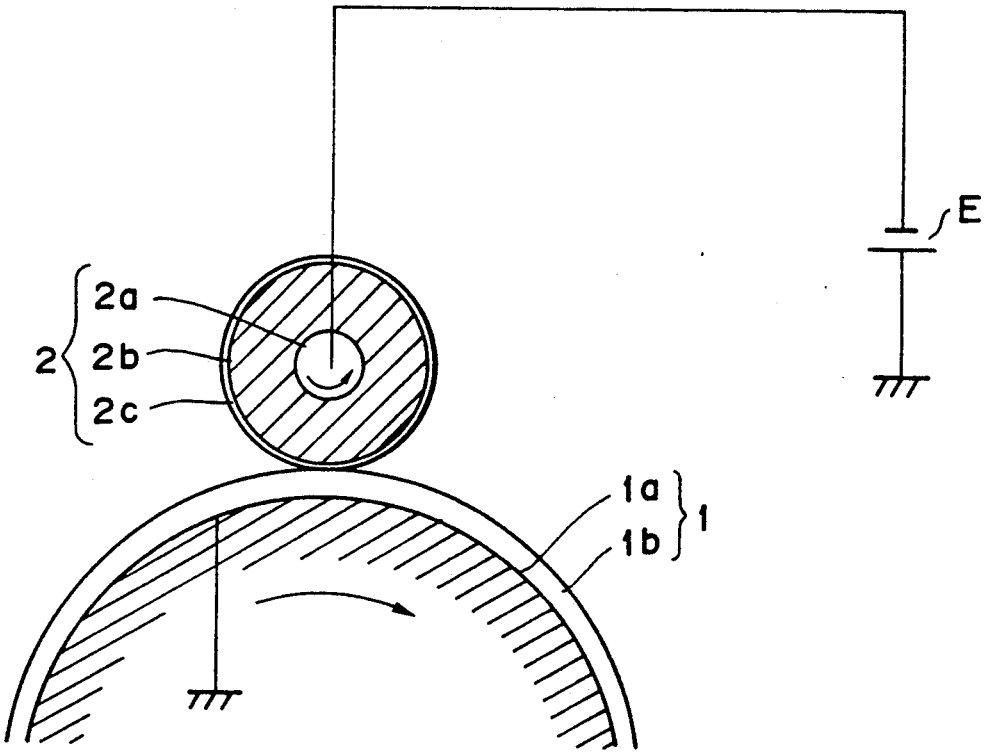
FIGS. 3 and 4 are schematic illustration of roller-shaped contact charging devices.

FIG. 3 schematically illustrates the constitution of an example of the contact charging device or assembly. Reference numeral 1 denotes a photosensitive drum which is a chargeable member serving as the electrostatic image bearing member, and is comprised of a conductive substrate comprising a drum substrate 1a made of aluminum, on the external surface of which an organic photoconductor (OPC) 1b serving as a photosensitive layer is formed. The photosensitive drum is rotated at a given speed in the direction of an arrow. In this example, the photosensitive drum 1 is 30 mm in outer diameter. Reference numeral 2 denotes a charging roller which is a charging member brought into contact with the photosensitive drum 1 at a given pressure, and is comprised of a metal mandrel 2a, a conductive rubber layer 2b provided thereon, and further provided on its external surface a surface layer 2c, a release film. The conductive rubber layer may preferably have a thickness of from 0.5 to 10 mm, and preferably from 1 to 5 mm. The surface layer in this example comprises a release film. It is preferred to provide this release film so that the developer and image forming method according to the present invention may match each other. However, a release film with an excessively large resistivity may give no electrostatic charges on the photosensitive drum 1 end on the other hand a release film wi&h an excessively small resistivity may cause an excessively large voltage applied to the photosensitive drum 1 to tend to damage the drum or produce pinholes, and hence the release film should have an appropriate resistivity. The release film should have a volume resistivity of from $10^9$ to $10^{14}$ Ω·cm. Here, the release film may preferably have a thickness of not more than 30 μm. The lower limit of the thickness of the film may be smaller so long as no peel or turn-up may occur, and can be considered to be about 5 μm. Preferably the release film should have o thickness of from 10 to 30 μm.

Figure 4:
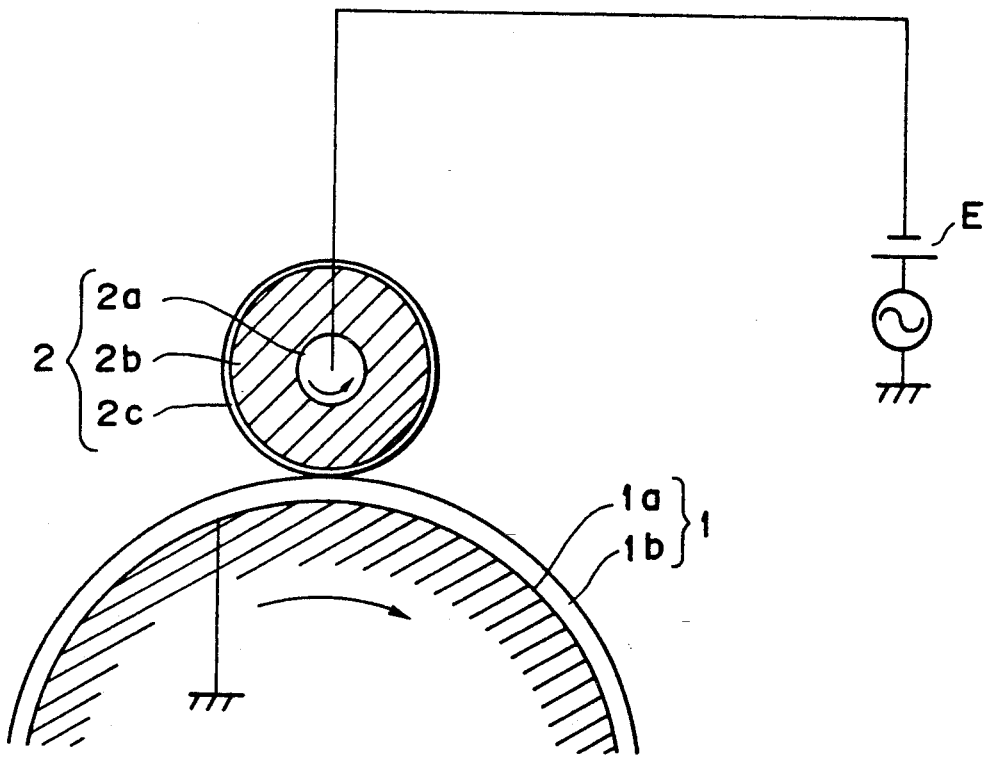

In this example, the charging roller 2 has an outer diameter of 12 mm. The conductive rubber layer 2b, having thickness of 3.5 mm, is composed of an ethylene-propylene-diene terpolymer (EPDM), and the surface layer 2c is formed of a nylon resin in a thickness of 10 μm. The charging roller 2 is made to have a hardness of 54.5° (ASKER-C). Letter symbol E denotes a power source that applies a voltage to the charging roller 2. It supplies a given voltage to the mandrel 2a (diameter: 5 mm) of the charging roller 2. In FIG. 3, the later symbol E indicates a DC voltage. It may preferably be a direct current overlaid with an AC voltage as shown in FIG. 4.

Preferable conditions used here for contact charging process are shown below.

Contact pressure: 5 to 500 g/cm

AC voltage: 0.5 to 5 KVpp

AC frequency: 50 to 3,000 Hz

DC voltage: −200 to −900 V

Figure 5:
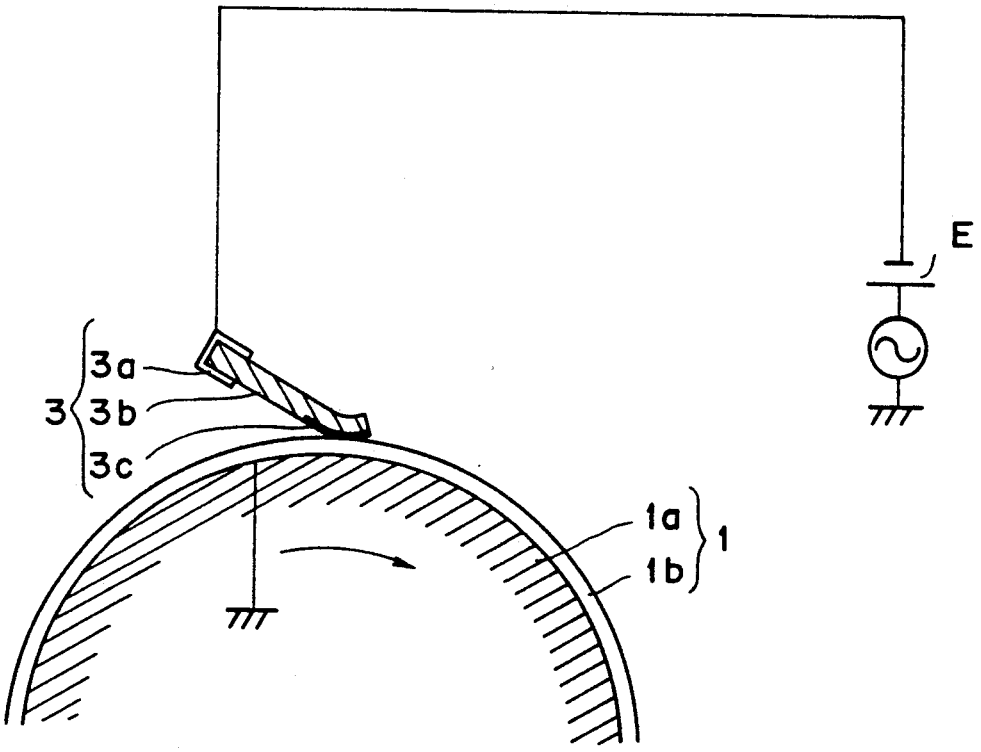
FIG. 5 is a schematic illustration of a blade-shaped contact charging device.

FIG. 5 schematically illustrates the constitution of another example of the contact charging member according to the present invention. The members common to those in the device shown in FIGS. 3 and 4 have the same reference number, and repetitive description thereon is omitted.

In this example, a contact charging member 3 is blade-shaped, which is brought into contact with the photosensitive drum 1 in the normal direction under a given pressure. This blade 3 is comprised of a holding metal member 3a to which a voltage is applied, a conductive rubber 3b supported by the member 3a, and a surface layer 3c serving as the release film, provided at the part coming into contact with the photosensitive drum 1. The surface layer 3c is formed of nylon in a thickness of 10 μm. According to this example, difficulties such as sticking of the blade to the photosensitive drum do not occur, and the same operation and effect as in the previous examples can be achieved.

In the examples described above, the roller-shaped or blade-shaped member is used as the charging member. Without limitation thereto, the present invention can also be carried out using a member with a different shape.

In the above examples, the charging member is constituted of a conductive rubber layer and a release film. Its constitution is by no means limited to it. For example, in some instances, a high-resistance layer (e.g., e hydrin rubber layer with less environmental variations) may preferably be formed between the conductive rubber layer and the release film surface layer so that leakage to the photosensitive member can be prevented.

As the material for the release film, PVDF (polyvinylidene fluoride) and PVDC (polyvinylidene chloride) may also be used in place of the nylon resin. As for the photosensitive member, amorphous silicon, selenium, ZnO, etc. can also be used. In the case then amorphous silicon is used in the photosensitive member, smeared images may seriously occur, compared with the case when other material is used, if the softening agent in the conductive rubber layer adheres to the photosensitive member even in a small quantity. Hence, it can be more effective to provide such an insulative coating on the outer side of the conductive rubber layer.

The present invention is particularly effective for an image forming apparatus comprising an electrostatic image bearing member (a photosensitive drum) whose surface is formed of an organic compound. This is because, in the case when an organic compound forms a surface layer, the binder resin containing the toner tends to adhere to the surface layer and hence the melt adhesion of toner tends to occur at the contact point particularly when the same materials are used.

Surface materials for the the electrostatic image bearing member according to the present invention may include silicone resin, vinylidene chloride, ethylene-vinyl chloride, styrene-acrylonitrile, styrene-methyl methacrylate, styrene, polyethylene terephthalate, and polycarbonate. The materials are by no means limited to these, and other monomers or their copolymers or blends with any of the exemplified resins can also be used.

The present invention is particularly effective for an image forming apparatus comprising an electrostatic image bearing member with a diameter of 50 mm or less. This is because, in the case of drums with a small diameter, pressure tends to be localized at the contact part because of a large curvature even under the same linear pressure.

The same phenomenon is considered to occur in belt type photosensitive members, and the present invention is particularly effective for an image forming apparatus wherein the curvature radius at the transfer portion is 25 mm or less.

The developer for developing an electrostatic image according to the present invention can be preferably used particularly in a heat roller fixing system. A heat roller fixing device is usually comprised of a heat roller, a pressure roller provided opposingly thereto, and a heat source built in the heating roller. A cleaning roller is optionally provided opposingly to the heating roller. In the fixing of the developer, a transfer medium with a toner image having been transferred thereto is passed through between the heating roller and the pressure roller while keeping the temperature of the heating roller to a given temperature by means of the heat source, whereby the toner image is brought into direct contact with the heating roller so that the toner image can be fixed by heat and pressure to the transfer medium. The heating roller may preferably be made of a fluorine type material or a silicone type material, which can remarkably improve the durability of the heating roller because of the cooperative action of the material and the developer of the present invention.

The image forming method and eleotrophotographic apparatus of the present invention will be described below with reference to FIG. 6.

The surface of a photosensitive member 501 serving as the electrostatic image bearing member is negatively charged by the operation of a contact charging assembly 502, the contact charging means previously described, having a voltage applying means 515, and a digital latent image is formed by image cleaning through exposure 505 using a laser beam. The latent image thus formed is reversely developed using a negatively chargeable one-component magnetic developer 510 held in a developing assembly 509 equipped with a developing sleeve 504 in which a magnetic blade 511 and a magnet are provided. In the developing zone, an AC bias, a pulse bias and/or a DC bias is/are applied between a conductive substrate of the photosensitive drum 501 and the developing sleeve 504 through a bias applying means 512. A transfer paper P is fed and delivered to a transfer zone, where the transfer paper P is electrostaticallV charged from its back surface (the surface opposite to the photosensitive drum) through a transfer means 503, so that the developed image (toner image) on the surface of the photosensitive drum is electrostatically transferred to the transfer paper P. The transfer paper P separated from the photosensitive drum 501 is subjected to fixing using a heat-pressure roller fixing unit (thermal platen) 507 so that the toner image on the transfer paper P can be fixed.

The one-component magnetic toner remaining on the photosensitive drum 501 after the transfer step is removed by the operation of a cleaning assembly 508 having a cleaning blade (or a cleaning roller). After the cleaning, the residual charges on the photosensitive drum 501 is eliminated by erase exposure 506 if necessary, and thus the procedure again starting from the charging step using the contact charging assembly 502 is repeated. The erase exposure may be omitted When an AC bias is applied to the contact charging assembly 502.

The electrostatic image bearing member (the photosensitive drum) comprises a photosensitive layer and a conductive substrate as previously described, and is rotated in the direction of an arrow. In the developing zone, the developing sleeve 504, a non-magnetic cylinder, which is the developer carrying member, is rotated so as to move in the same direction as the direction in which &he electrostatic image bearing member is rotated. In the inside of the non-magnetic cylindrical sleeve 504, a multi-polar permanent magnet (magnet roll) serving as a magnetic field generating means is provided in an unrotatable state The one-component insulating magnetic toner 510 held in the developing assembly 509 is coated on the surface of the non-magnetic cylindrical sleeve 504, and, for example, minus triboelectric charges are imparted to the developer because of the friction between the surface of the sleeve 504 and the the developer. A doctor blade 511 made of iron is disposed opposingly to one of the magnetic pole positions of the multi-polar permanent magnet, in proximity (with a space of from 50 μm to 500 μm) to the surface of the cylinder. Thus, the thickness of a toner layer can be controlled to be small (from 30 μm to 300 μm) and uniform so that a oner layer smaller in thickness than the gap between the electrostatic image bearing member 501 and developer carrying member 504 in the developing zone can be formed in a non-contact state. The rotational speed of &his developer carrying member 504 is regulated so that the peripheral speed of the sleeve can be substantially equal or close to the speed of the peripheral speed of the electrostatic image bearing member. As the magnetic doctor blade 511, a permanent magnet may be used in place of iron to form an opposing magnetic pole. In the developing zone, the AC bias or pulse bias may be applied through the bias means 501, across the developer carrying member 504 and the surface of the electrostatic image bearing member 501. This AC bias may have a frequency of from 200 to 4,000 Hz, and a Vpp of from 500 to 3,000 V.

When the toner particles are moved in the developing zone, the toner particles are moved to the side of an electrostatic image by the electrostatic force of the electrostatic image bearing member surface and the action of the AC bias or pulse bias.

In place of the magnetic doc&or blade 511, an elastic blade formed of an elastic material such as silicone rubber may be used so that the layer thickness of the developer layer can be controlled by pressure and the developer can be thereby coated on the developer carrying member.

The cleaning step may be simultaneously carried out in the charging step, developing step or transfer step.

The electrophotographic apparatus may be constituted of a combination of plural components integrally joined as one apparatus unit from among the constituents such as the above electrostatic image bearing member, developing means and cleaning means so that the unit can be freely mounted on or detached from the body of the apparatus. For example, at least one of the contact charging means, developing means and cleaning means may be integrally supported together with the electrostatic image bearing member to form one unit that can be freely mounted on or detached from the body of &he apparatus, and the unit can be freely mounted or detached using a guide means such as a rail provided in ±he body of the apparatus.

Figure 8:
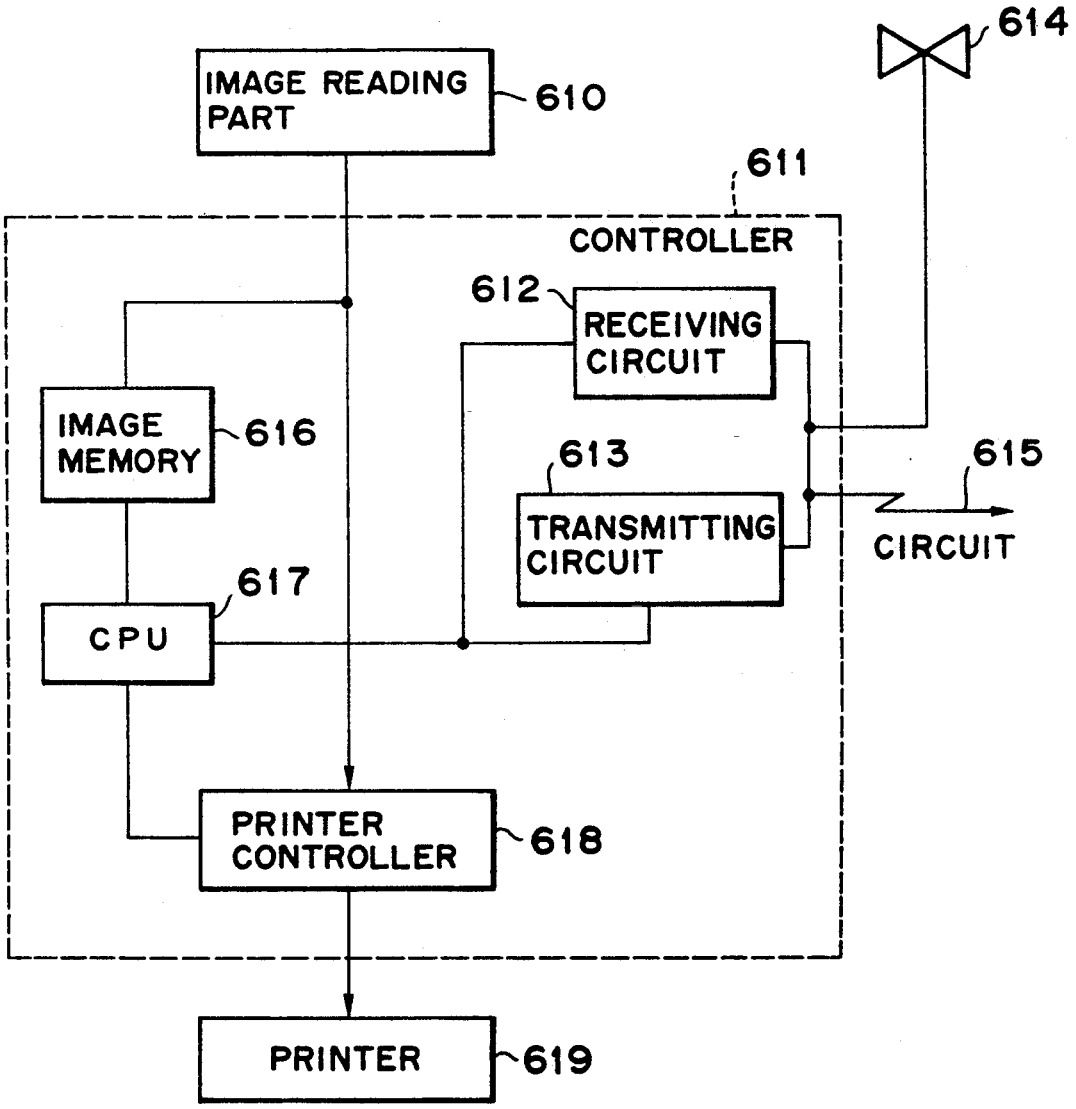
FIG. 8 is a block diagram to illustrate the facsimile apparatus of the present invention.

In the case when the electrophotographic apparatus of the present invention is used as a printer of a facsimile machine, optical image exposing light 505 serves as exposing light used for the printing of received data. FIG. 8 illustrates an example thereof in the form of a block diagram.

A controller 611 controls an image reading part 610 and a printer 619. The whole of the controller 611 is controlled by CPU 617. Image data outputted from the image reading part is sent to the other facsimile station through a transmitting circuit 613. Data received from the other station is sent to a printer 619 through a receiving circuit 612. Given image data are stored in an image memory 616. A printer controller 618 controls the printer 619. The numeral 614 denotes a telephone.

An image received from a circuit 615 (image information from a remote terminal connected through the circuit) is demodulated in the receiving circuit 612, and then successively stored in an image memory 616 after the image information is decoded by the CPU 617. Then, when images for at least one page have been stored in the memory 616, the image recording for that page is carried out. The CPU 617 reads out the image information for one page from &he memory 616 and sends the coded image information for one page to the printer controller 618. The printer controller 618, having received the image information for one page from the CFU 617, controls the printer 619 so that the image information for one page is recorded.

The CPU 617 receives image information for next page in the course of the recording by the printer 619.

Fundamental constitution and characteristic features of the present invention are as described above. In the following, the present invention will be specifically described by giving Examples. It should be noted that the working embodiments of the present invention are by no means limited by these. In the following examples, "part(s)" refers to "part(s) by weight".

PREPARATION OF TONERS

Preparation Example 1

| | |
|---|---|
| Styrene/n-butyl methacrylate/divinylbenzene copolymer (copolymerization ratio: 70:29:1; Mw: 280,000) | 100 parts |
| Fine magnetic powder (BET value: 7.5 $m^2/g$) | 100 parts |
| Negative charge control agent (exemplary complex (I)-3) | 0.5 part |

The above materials were melt-kneaded using a twin-screw extruder heated to 140° C. After cooled, the kneaded product was crushed using a hammer mill to give coarse particles, which were then finely pulverized using a jet mill. The resulting finely pulverized product was subjected to air classification to give a classified magnetic powder (magnetic toner 1) with a weight average particle diameter ($D_4$) of 6.8 μm (number average particle diameter: 5.2 μm) (Tg: 60° C.). The magnetic toner obtained had negative triboelectric chargeability and also had electrical insulating properties.

Preparation Example 2

A classified magnetic powder (magnetic toner 2) having the same average particle diameter as that in Preparation Example 1 gas obtained in the same manner as in Preparation Example 1 except that as the charge control agent &he exemplary complex (I)-3 was replaced with exemplary complex (I)2.

Preparation Example 3

A classified magnetic powder (magnetic toner 3) having the same average particle diameter as that in Preparation Example 1 was obtained in the same manner as in Preparation Example 1 except that as the charge control agent the exemplary complex (I)-3 was replaced with exemplary complex (I)-6.

Preparation Example 4

A classified magnetic powder (magnetic toner 4) having the same average particle diameter as that in preparation Example 1 was obtained in the same manner as in preparation Example 1 except that no negative charge control agent was used.

Preparation Example 5

A classified magnetic powder (magnetic toner 5) with a weight average particle diameter of 12.5 μm, having the same average particle diameter as that in Preparation Example 1 was obtained in the same manner as in preparation Example 1 except that the fine magnetic powder was used in an amount of 60 parts.

Examples 1 to 5 & Comparative Examples 1 to 5

Fine resin particles and hydrophobic fine silica powder as shown in the following Tables 1 and 2, respectively, were added to 100 parts of the above magnetic toners in the combination as shown in Table 3, end mixed using a Henschel mixer to give one-component magnetic developers.

Figure 6:
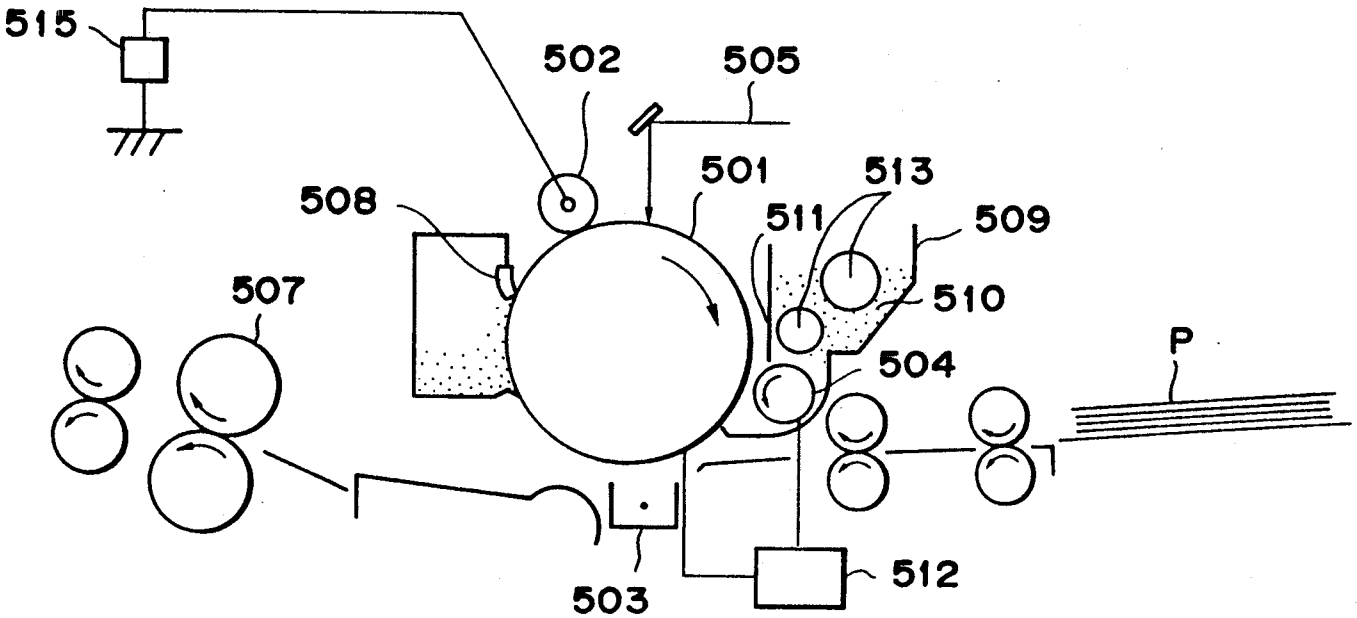
FIG. 6 is a schematic illustration of an example of the apparatus for carrying out the image forming method of the present invention.
Figure 7:
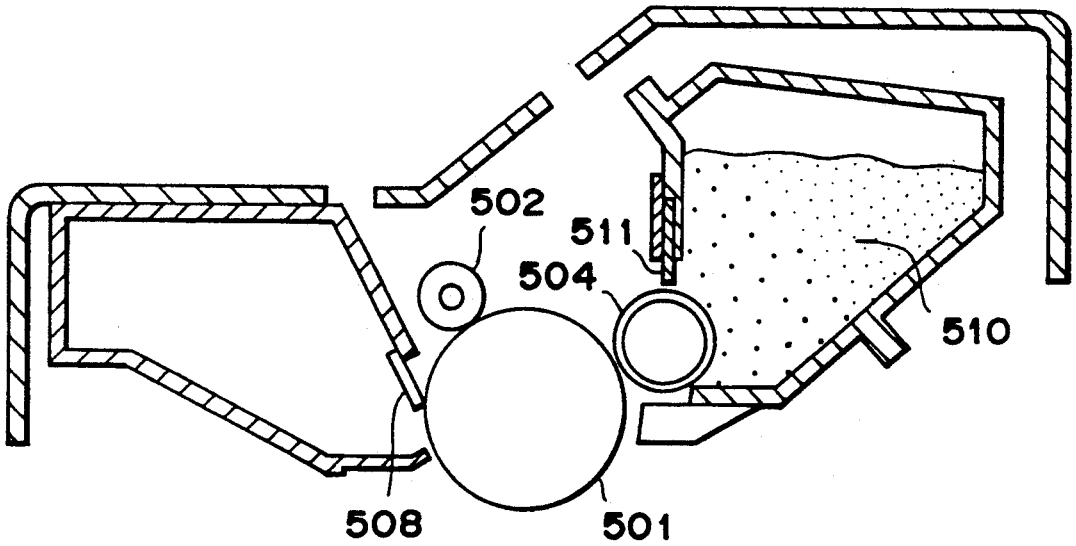
FIG. 7 is a schematic illustration of an example of the apparatus unit of the present invention.

Next, these respective one-component magnetic developers thus prepared were each loaded in the electrophotographic apparatus as shown in FIG. 6 (a modified machine of LBP-811, manufactured by Canon Inc.) having a contact charging assembly and a cleaning blade made of polyurethane. While applying a DC voltage (−700 V) and an AC voltage (500 Hz, 2,000 Vpp) to the contact charging assembly, practical copy tests to form toner images continuously on A4-size paper at e printing speed of 16 sheets/min according to the reversal development system were carried out in an environment of log temperature and low humidity (15° C., 10% RH), and print-out images were evaluated. At the same time, the state of the surface of the charging member (roller type) was examined.

The photosensitive member used was an OPC photosensitive member comprising a drum substrate on the external surface of which a photosensitive layer comprised of a charge generation layer and a charge transport layer (comprising a charge transporting compound dispersed in polycarbonate resin), and the photosensitive member had a surface with abrasion characteristics of $2.5\times10^{-2}$ $cm^3$ as abrasion wear measured using a Taber's abrasion resistance tester.

As previously described, the charging roller 2 has a diameter of 12 mm, the mandrel has a diameter of 5 mm, the conductive rubber layer **2*b*** has a thickness of about 3.5 mm, and the release film formed of methoxymethylated nylon has a thickness of 20 μm. The roller was brought in&o pressure contact with the OPC photosensitive member at a total pressure of 1.2 kg (linear pressure: 55 g/cm).

In the image forming apparatus, the toner layer on the sleeve gas made to have a thickness of 130 μm, and the gap where the sleeve and the OPC photosensitive member become closest was set to be 300 μm. Image reproduction tests were carried out while applying a DC bias (−500 V) and an AC bias (1,800 Hz, 1,600 Vpp) to the developing sleeve.

Tables 1 and 2 show physical properties of the fine resin particles (A) and those of the fine silica powder (B), respectively. Table 3 shows the composition of each developer and the results of evaluation. As the charging device, the blade type charging assembly as shown in FIG. 4 was used in Example 5, and the roller type as shown in FIG. 4 was used in Examples 1 to 4 and Comparative Examples 1 to 5.

Charge non-uniformity due to the contamination of the charging member was evaluated by observing lateral line images of about 100 μ in line intervals and about 100 μ in line width.

Figure 12:
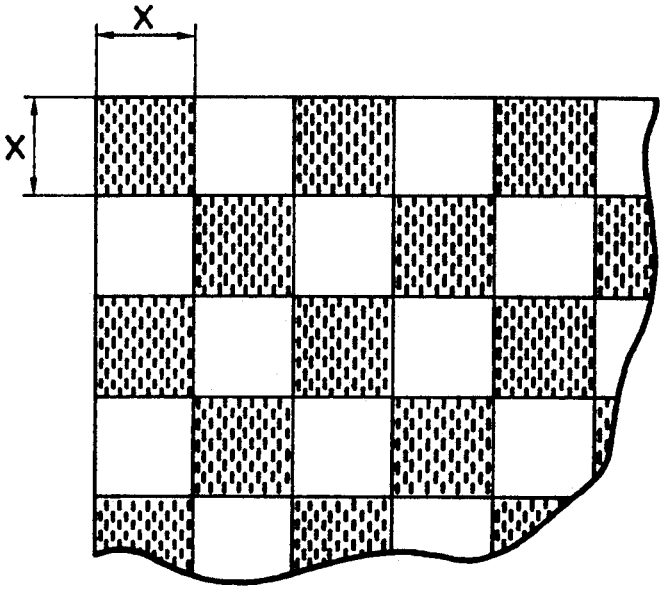
FIG. 12 illustrates a checker pattern.

Do& reproduction was evaluated by observing wi&h a microscope &he reproduction of images formed, after 10,000 sheet running, by developing a checker pattern as shown in FIG. 12, comprised of squares each one side of which was 100 μm or 50 μm.

TABLE 1

| Fine resin particles A | | | | | |
|---|---|---|---|---|---|
| Fine resin particles | Surface shape sphericity ψ | Number av. particle diameter (μm) | Volume resistivity (Ω · cm) | Charge quantity (μc/g) | Composition and monomer unit (wt. %) |
| A-1 | 0.86 | 0.6 | $3\times10^{10}$ | −10 | St/MMA/BA (53/35/12) |
| A-2 | 0.69 | 0.6 | $3\times10^{12}$ | −26 | St/MMA/BMA (65/20/15) |
| A-3 | 0.78 | 0.05 | $6\times10^{8}$ | −28 | St/MMA/2EHA (60/20/20) |
| A-4* | 0.99 | 0.5 | $5\times10^{13}$ | +50 | MMA |
| A-5* | 0.98 | 0.6 | $7\times10^{16}$ | −70 | MMA/BA (85/15) |

*Comparative Example
St: Styrene
MMA: Methyl methacrylate,
BA: Butyl acrylate
BMA: Butyl methacrylate
2EHA: 2-Ethylhexyl acrylate

TABLE 2

| Fine silica powder B | | | | |
|---|---|---|---|---|
| Fine silica powder | BET Surface specific area ($m^2/g$) | Number av. diameter of primary particles (μm) | Charge quantity (μc/g) | Treatment agent |
| B-1 | 200 | 0.012 | −175 | Hexamethyldisilazane + dimethylsilicone oil |
| B-2 | 300 | 0.008 | −240 | Dimethylsilicone oil |
| B-3 | 200 | 0.012 | −30 | Control |

TABLE 3

| | | | | | | Results of Evaluation | | | | | | | | | |
|---|---|---|---|---|---|---|---|---|---|---|---|---|---|---|---|
| | | | | | | Image density | | | | Charge non-uniformity due to contamination of contact charging member | | | Dot reproduction | | |
| | Toner | Fine resin particles | | Fine silica powder | | Initial | 30 × 100 sh. | 60 × 100 sh. | After 100 × 100 sh. | 30 × 100 sh. | 60 × 100 sh. | 100 × 100 sh. | x = 100μ | x = 50μ | Image density non-uniformity |
| Example: | | | | | | | | | | | | | | | |
| 1 | 1 | A-1 | 0.2 | B-1 | 0.8 | 1.4 | 1.4 | 1.4 | 1.4 | A(No) | A(No) | A(No) | A | A | A |
| 2 | 2 | A-1 | 0.2 | B-1 | 0.8 | 1.4 | 1.4 | 1.4 | 1.4 | A(No) | A(No) | A(No) | A | A | A |
| 3 | 3 | A-1 | 0.2 | B-1 | 0.8 | 1.4 | 1.4 | 1.4 | 1.4 | A(No) | A(No) | A(No) | A | A | A |
| 4 | 1 | A-2 | 0.15 | B-2 | 0.5 | 1.3 | 1.35 | 1.4 | 1.4 | A(No) | A(No) | A(No) | A | A | A |
| 5 | 1 | A-3 | 0.05 | B-1 | 1.2 | 1.4 | 1.4 | 1.4 | 1.4 | A(No) | A(No) | A(No) | A | A | A |
| 6 | 4 | A-1 | 0.2 | B-1 | 1.5 | 1.4 | 1.3 | 1.2 | 1.7 | A(No) | A(No) | A(No) | A | A | A |
| 7 | 5 | A-1 | 0.2 | B-1 | 0.3 | 1.4 | 1.4 | 1.35 | 1.3 | A(No) | A(No) | A(No) | A | B | A |
| Comparative Example: | | | | | | | | | | | | | | | |
| 1 | 1 | None | | B-2 | 0.5 | 1.1 | 1.2 | 1.2 | 1.3 | A(No) | A(No) | C(*2) | A | A | A |

TABLE 3-continued

| | | | | | | Results of Evaluation | | | | | | | | | |
|---|---|---|---|---|---|---|---|---|---|---|---|---|---|---|---|
| | | | | | | Image density | | | | Charge non-uniformity due to contamination of contact charging member | | | Dot reproduction | | |
| | Toner | Fine resin particles | | Fine silica powder | | Initial | 30 × 100 sh. | 60 × 100 sh. | After 100 × 100 sh. | 30 × 100 sh. | 60 × 100 sh. | 100 × 100 sh. | x = 100μ | x = 50μ | Image density non-uniformity |
| 2 | 1 | A-4 | 0.2 | B-2 | 1.2 | 1.2 | 1.2 | 1.3 | 1.4 | A(No) | A(No) | C(*3) | A | A | C |
| 3 | 3 | A-5 | 0.2 | B-3 | 0.8 | 1.2 | 1.1 | 1.1 | 1.0 | A(No) | C(*1) | — | A | A | C |

(*1): Occurred on 5,000 sheets
(*2): Occurred on 8,000 sheets
(*3): Occurred on 9,000 sheets
Remarks:
(1) Amounts of the fine resin particles and fine silica powder added are indicated as parts by weight based on 100 parts by weight of the toner.
(2) Evaluation of dot reproduction (reproduction of 100 black dots): A: Two or less dots lacked, B: Three of more dots lacked.

Preparation Example 6

| | |
|---|---|
| Styrene/n-butyl methacrylate/divinylbenzene copolymer (copolymerization ratio: 70:29:1; Mw: 280,000) | 100 parts |
| Fine magnetic powder (BET value: 7.5 $m^2/g$) | 80 parts |
| Negative charge control agent: 3,5-di-tert-butylsalicylic acid chromium complex | 2 parts |
| Low-molecular weight polypropylene (Mw/Mn = 5.8) | 8 parts |

The above materials were melt-kneaded using a twin-screw extruder heated to 140° C. After cooled. the kneaded product was crushed using a hammer mill to give coarse particles, which were then finely pulverized using a jet mill. The resulting finely pulverized product was subjected to air classification to give a classified magnetic powder (magnetic toner 6) with a weight average particle diameter ($D_4$) of 7.8 μm (number average particle diameter: 6.1 μm) (Tg: 60° C.).

Preparation Example 7

A classified magnetic powder (magnetic toner 7) having the same average particle diameter as that in Preparation Example 6 gas obtained in the same manner as in Preparation Example 6 except that a polypropylene of Mw/Mn=6.5 was used as the low-molecular weight polypropylene.

Preparation Example 8

A classified magnetic powder (magnetic toner 8) having the same average particle diameter as that in Preparation Example 6 gas obtained in the same manner as in Preparation Example 6 except that the low-molecular weight polypropylene gas replaced with a blend of a low-molecular weight polyethylene and a low-molecular weight polypropylene (Mw/Mn=8.2).

Preparation Example 9

A classified magnetic powder (magnetic toner 9) having the same average particle diameter as that in Preparation Example 6 was obtained in the same manner as in Preparation Example 6 except that no low-molecular weight polypropylene was used.

Examples 8 to 12 & Comparative Examples 4 to 7

Fine resin particles and hydrophobic fine silica powder as shown in the above Tables 1 and 2, respectively, were added to &he above magnetic toners in the combination as shown in Table 4, and mixed using a Henschel mixer to give developers.

Using the respective developers thus obtained, images were reproduced and evaluated in the same manner as in Example 1 or 5. Results obtained are shown in Table 4.

TABLE 4

| | | | | | | Results of Evaluation | | | | |
|---|---|---|---|---|---|---|---|---|---|---|
| | Toner | Fine resin particles | | Fine silica powder | | Image density | Charge non-uniformity due to contamination of contact charging member (after 10,000 sheet running) | Anti-offset | Image density non-uniformity | Contact charging member |
| Example: | | | | | | | | | | |
| 8 | 6 | A-1 | 0.2 | B-1 | 0.8 | 1.4 | A (Not occur) | A | A | Roller |
| 9 | 7 | A-1 | 0.2 | B-1 | 0.8 | 1.4 | A (Not occur) | A | A | Roller |
| 10 | 8 | A-1 | 0.2 | B-1 | 0.8 | 1.4 | A (Not occur) | A | A | Roller |
| 11 | 6 | A-2 | 0.15 | B-2 | 0.5 | 1.3 | A (Not occur) | A | A | Roller |
| 12 | 6 | A-3 | 0.05 | B-1 | 1.2 | 1.4 | A (Not occur) | A | A | Blade |
| Comparative Example: | | | | | | | | | | |
| 4 | 6 | None | | B-2 | 0.5 | 1.0 | C (Occur on 6,000 sheets) | A | A | Roller |
| 5 | 6 | A-4 | 0.2 | B-2 | 1.2 | 1.3 | C (Occur on 8,000 sheets) | A | C | Roller |
| 6 | 8 | A-5 | 0.2 | B-3 | 0.8 | 1.4 | C (Occur on 4,000 sheets) | A | C | Roller |
| 7 | 9 | A-4 | 0.2 | B-1 | 0.8 | 1.3 | C (Occur on 8,000 sheets) | C | C | Roller |

Amounts of the fine resin particles and fine silica powder added are indicated as parts by weight based on 100 parts by weight of the toner.

PREPARATION OF TONER PARTICLES

Preparation Example 10

| | |
|---|---|
| Copolymer I | 100 parts |
| Fine magnetic powder (BET value: 7.5 $m^2/g$) | 80 parts |
| Negative charge control agent: 3,5-di-tert- | 2 parts |

-continued

| |
|---|
| butylsalicylic acid chromium complex |

The above materials were melt-kneaded using a twin-screw extruder heated to 140° C. After cooled, the kneaded product gas crushed using a hammer mill to give coarse particles, which were then finely pulverized using a jet mill. The resulting finely pulverized product was subjected to air classification to give a classified magnetic powder (magnetic toner 10) with a weight average particle diameter ($D_4$) of 7.8 μm (number average particle diameter: 6.1 μm) (Tg: 60° C.).

Preparation Example 11 to 13

Classified magnetic powders (magnetic toners 11 to 13) having the same average particle diameter as that in preparation Example 10 were obtained in the same manner as in Preparation Example 10 except that the copolymer I gas replaced with copolymer II to IV, respectively.

Table 5 shows the composition of each copolymer, Tg, and weight fraction of the region with a molecular weight of not more than 5,000 in the measurement by GPC after the toners have been formed.

TABLE 5

| Magnetic toner | Copolymer | Composition of copolymer: Composition | Tg | Weight fraction (%)* |
|---|---|---|---|---|
| 10 | I | St/BA/MB (75/15/10) | 60° C. | 18.5 |
| 11 | II | St/BA/BMA/MB (70/10/15/5) | 59° C. | 25.4 |
| 12 | III | St/2EHA/MB (68/25/7) | 60° C. | 20.1 |
| 13 | IV | St/BA (80/20) | 61° C. | 10.3 |

*Weight fraction of region with molecular weight of ≦5,000 in the measurement by GPC after toner
St: Styrene
BA: Butyl acrylate
BMA: Butyl methacrylate
2EHA: 2-Ethylhexyl acrylate
MB: Monobutyl maleate Examples 13–17 & Comparative Examples 8–11

Fine resin particles and hydrophobic fine silica powder as shown in the above Tables 1 and 2, respectively, were added to the above magnetic toners in the combination as shown in Table 6, and mixed using a Hauschel mixer to give developers.

Using the respective developers thus obtained, images were reproduced and evaluated in the same manner as in Example 1 or 5. Results obtained are shown in Table 6.

Similar tests were also carried out in an environment of high temperature and high humidity (32.5° C., 85% RH). Print-out images were evaluated, and the state of the surface of the charging member was examined.

Charge non-uniformity due to the contamination of the charging member was examined on lateral line images of about 100 μ in intervals and about 100 μ in line width (in an environment of low temperature and low humidity).

Melt adhesion of toner to the surface of the photosensitive member was evaluated on the basis of the number of white dots in solid black images. (Since it tends to occur in an environment of high temperature and high humidity, tests were carried out in a environment of high temperature and high humidity.)

Criterions for the evaluation are as shown below.

Melt adhesion of toner to the photosensitive member surface:

A: No melt adhesion at all.

AB: Melt adhesion giving 1 to 3 white dots in an A4 solid black image.

B: Melt adhesion giving 3 to 10 white dots in an an A4 solid black image.

C: Melt adhesion giving 10 or more white dots in an A4 solid black image.

Fixing performance was evaluated in the following way: In an environment of normal temperature and normal humidity (23.5° C., 60% RH), a power source was switched on after the evaluation machine became accustomed to that environment. Immediately after wait-up, lateral line patterns of 200 μ in line width width: 200 μ; intervals: 200 μm) were printed (on A4 paper set lengthwise). A printed image on the first sheet was used for the evaluation of fixing performance. For the evaluation of fixing performance, the image was rubbed to and fro five times with Silbon paper under a load of 100 g, and image come-off was examined on the basis of the average of image density fall rates (%).

In the evaluation, bond paper with a surface smoothness of 10 (sec) or less was used. Criterions of the evaluation are as shown below.

Fixing performance:

A: Good (density fall rate: less than 10%)

B: A little poor, but tolerable for practical use (density fall rate: not less than 10% and less than 20%)

C: Untolerable for practical use (density fall rate: not less than 20%).

TABLE 6

| | Toner | Fine resin particles | | Fine silica powder | | Image density | Results of Evaluation: Charge non-uniformity in low temp. low humidity environment (10,000 sh. running) | Melt adhesion of toner (after 10,000 running)*1 | Fixing performance | Image density non-uniformity | Contact charging member |
|---|---|---|---|---|---|---|---|---|---|---|---|
| Example: | | | | | | | | | | | |
| 13 | 10 | A-1 | 0.2 | B-1 | 0.8 | 1.4 | A (Not occur) | AB | A | A | Roller |
| 14 | 11 | A-1 | 0.2 | B-1 | 0.8 | 1.4 | A (Not occur) | AB | A | A | Roller |
| 15 | 12 | A-1 | 0.2 | B-1 | 0.8 | 1.4 | A (Not occur) | AB | A | A | Roller |
| 16 | 10 | A-2 | 0.15 | B-2 | 0.5 | 1.3 | A (Not occur) | A | A | A | Roller |
| 17 | 10 | A-3 | 0.05 | B-1 | 1.2 | 1.4 | A (Not occur) | B | B | A | Blade |
| Comparative Example: | | | | | | | | | | | |
| 8 | 10 | None | | B-2 | 0.5 | 1.2 | C (Occur on 10,000 sh.) | C | A | A | Roller |
| 9 | 10 | A-4 | 0.2 | B-2 | 1.2 | 1.4 | C (Occur on 7,000 sh.) | B | B | C | Roller |
| 10 | 12 | A-5 | 0.2 | B-3 | 0.8 | 1.0 | C (Occur on 5,000 sh.) | AB | A | C | Roller |

TABLE 6-continued

| | Toner | Fine resin particles | | Fine silica powder | | Image density | Results of Evaluation: Charge non-uniformity in low temp. low humidity environment (10,000 sh. running) | Melt adhesion of toner (after 10,000 running)*1 | Fixing performance | Image density non-uniformity | Contact charging member |
|---|---|---|---|---|---|---|---|---|---|---|---|
| 11 | 13 | A-4 | 0.2 | B-1 | 0.8 | 1.4 | C (Occur on 7,000 sh.) | AB | C | A | Roller |

*1: In a environment of high temperature and high humidity.
Amounts of the fine resin particles and fine silica powder added are indicated as parts by weight based on 100 parts by weight of the toner.

Preparation Example 14

| | |
|---|---|
| Styrene/n-butyl aorylate copolymer (copolymerization ratio: 8:2; Mw: 270,000) | 100 parts |
| Fine magnetic powder (BET value: 8.5 $m^2/g$) | 60 parts |
| Negative charge control agent (a monoazo dye chromium complex) | 0.6 part |
| Low-molecular weight polypropylene (Mw: 6,000) | 3 parts |

The above materials were melt-kneaded using a twin-screw extruder heated to 140° C. After cooled the kneaded product was crushed using a hammer mill to give coarse particles, which were then finely pulverized using a jet mill. The resulting finely pulverized product was subjected to air classification to give a classified magnetic powder (magnetic toner 14) with a volume average particle diameter of 12 μm (Tg: 60° C.).

Preparation Example 15

| | |
|---|---|
| Styrene/2-ethylhexyl acrylate/maleic acid n-butyl half ester copolymer (copolymerization ratio: 7:2:1, Mw: 200,000) | 100 parts |
| Fine magnetic powder (BET value: 7.5 $m^2/g$) | 60 parts |
| Negetive charge control agent (a salicylic acid chromium complex) | 2 parts |
| Low-molecular weight polypropylene (Mw: 6,000) | 3 parts |

Low-molecular weight polypropylene (Mw: 6.000)

The above materials were treated in the same manner as in Example 14 to give a classified magnetic powder (magnetic toner 15) (Tg: 55° C.).

Examples 18–22 & Comparative Examples 12–14

Fine resin particles as shown in the following Table 7 and fine silica powders as shown in Table 2 previously set out and the above classified magnetic toners were mixed using a Henschel mixer in the combination as shown in Table 8, to give one-component magnetic developers having the toner to which the fine resin particles and fine silica powder had been externally added.

Next, these respective one-component magnetic developers thus prepared were each loaded in the image forming apparatus as shown in FIG. 6 (a modified machine of LBP-811, manufactured by Canon Inc.) having a contact charging assembly. While applying a DC voltage and an AC voltage (500 Hz, 2,000 Vpp), practical copy tests to form toner images continuously on A4-size paper at a printing speed of 16 sheets/min according to the reversal development system were carried out in an environment of normal temperature and normal humidity (25° C., 60% RH), and print-out images were evaluated. At the same time, the state of the surfaces of the charging member (roller type) and OPC photosensitive drum was examined.

Table 7 shows physical properties of the fine resin particles (A). Table 8 shows the composition of each developer and the results of evaluation.

Criterions for the evaluation are shown below.

Fogging:

A: Almost no fogging.

B: Fogging occurs, but tolerable for practical use.

C: Untolerable for practical use.

Melt adhesion of toner to OPC photosensitive member:

A: No melt adhesion at all.

AB: Melt adhesion giving 1 to 3 white dots in an A4 solid black image.

B: Melt adhesion giving 3 to 10 white dots in an A4 solid black image.

C: Melt adhesion giving 10 or more white dots in an A4 solid black image.

Charge non-uniformity:

A: No charge non-uniformity at all.

B: Charge non-uniformity a little occurs, but tolerable for practical use.

C: Charge non-uniformity clearly occurs. Untolerable for practical use.

TABLE 7

| Fine Resin Particles (A) | sphericity ψ | Particle size (μm) | Specific resistance (Ω · cm) | Tribo-electricity (μc/g) | Tg (°C.) | Monomer composition of fine resin particles |
|---|---|---|---|---|---|---|
| A-6 | 0.88 | 0.5 | $2 \times 10^8$ | −40 | 110 | St/MMA/2EHA (70/20/10) |
| A-7 | 0.65 | 0.6 | $3 \times 10^7$ | −20 | 101 | St/MMA/BMA (75/15/10) |
| A-8 | 0.52 | 0.5 | $5 \times 10^6$ | −60 | 90 | St/MMA/2EHA (80/5/15) |
| A-9 | 0.75 | 0.9 | $5 \times 10^{12}$ | −5 | 105 | St/MMA (55/45) |
| A-10 | 0.80 | 0.05 | $8 \times 10^{11}$ | −200 | 98 | St/MMA/2EHA (70/10/20) |
| A-11* | 1.00 | 0.3 | $2 \times 10^{10}$ | +90 | 95 | MMA/BA (90/10) |
| A-12* | 0.97 | 1.2 | $1 \times 10^{14}$ | −30 | 102 | St/MMA |

TABLE 7-continued

| | Fine Resin Particles (A) | | | | | |
|---|---|---|---|---|---|---|
| | sphericity ψ | Particle size (μm) | Specific resistance (Ω · cm) | Tribo-electricity (μc/g) | Tg (°C.) | Monomer composition of fine resin particles |
| | | | | | | (20/80) |

*Comparative Example

TABLE 8

| | Results of Evaluation | | | | | | | | |
|---|---|---|---|---|---|---|---|---|---|
| | Magnetic Toner | Fine resin particles-A Type | Fine resin particles-A Amt. | Fine inorganic powder-B Type | Fine inorganic powder-B Amt. | (1) | Fogging | (2) | (3) |
| Example: | | | | | | | | | |
| 18 | 14 | A-6 | 0.1 | B-1 | 0.5 | A | A | A | 1.4 |
| 19 | 14 | A-7 | 0.05 | B-1 | 0.5 | A | A | A | 1.4 |
| 20 | 14 | A-8 | 0.2 | B-2 | 0.6 | A | A | A | 1.4 |
| 21 | 15 | A-9 | 0.9 | B-2 | 1.2 | A | A | A | 1.35 |
| 22 | 15 | A-10 | 0.02 | B-2 | 0.4 | A | A | A | 1.4 |
| Comparative Example: | | | | | | | | | |
| 12 | 14 | A-11 | 0.1 | B-1 | 0.5 | A | C | C | 1.4 |
| 13 | 15 | A-12 | 0.5 | B-2 | 0.8 | C | C | C | 1.35 |
| 14 | 15 | — | — | B-3 | 0.5 | C | A | A | 0.9 |

(1): Melt adhesion of toner to photosensitive member after 12,000 sheets running
(2): Charge non-uniformity (after 12,000 sheets running)
(3): Image density As having been described above, use of the specific fine resin particles in combination with the fine inorganic powder such as hydrophobic fine silica powder is effective for removing the free fine inorganic powder to protect the surface of the photosensitive member, and hence the developer of the present invention can give a toner image that is free from toner contamination or fogging and has a high quality.

We claim:

1. An electrophotographic apparatus comprising;
an electrostatic image bearing member;
a contact charging member to which a voltage is externally applied, which electrostatically charges said electrostatic image bearing member while being brought into contact with it;
an electrostatic image forming means for forming an electrostatic image on the charged electrostatic image bearing member;
a developing means for developing the electrostatic image thus formed; said developing means comprising a developer carrying member and a developer container that holds therein a developer; said developer comprising a toner, fine resin particles with a surface shape sphericity ψ of from 0.90 to 0.50, and fine inorganic particles; and
a transfer means for transferring the toner image formed on said electrostatic image bearing member to a transfer medium.

2. The electrophotographic apparatus according to claim 1, wherein said electrostatic image bearing member has an OPC photosensitive layer.

3. The electrophotographic apparatus according to claim 1, wherein said contact charging member is connected with a voltage applying means for applying a direct current voltage.

4. The electrophotographic apparatus according to claim 1, wherein said contact charging member is connected with a voltage applying means for applying an alternating current voltage.

5. The electrophotographic apparatus according to claim 1, wherein said contact charging member is connected with a voltage applying means for applying a direct current vol&age overlaid with an alternating current voltage.

6. The electrophotographic apparatus according to claim 1, wherein said contact charging member is roller-shaped.

7. The electrophotographic apparatus according to claim 6, wherein said contact charging member has a release film surface layer.

8. The electrophotographic apparatus according to claim 1, wherein said contact charging member is blade-shaped.

9. The electrophotographic apparatus according to claim 1, wherein said electrostatic image bearing member is provided with a cleaning means for cleaning a toner remaining after transfer.

10. The electrophotographic apparatus according to claim 9, wherein said cleaning means is provided with a cleaning blade.

11. The electrophotographic apparatus according to claim 1, wherein said fine resin particles have an average particle diameter smaller than the average particle diameter of said toner and larger than the average particle diameter of said fine inorganic powder.

12. The electrophotographic apparatus according to claim 1, wherein said fine resin particles have a primary average particle diameter of from 0.03 μ to 1.0 μ.

13. The electrophotographic apparatus according to claim 1, wherein said fine resin particles have a primary average particle diameter of from 0.05 μ to 0.8 μ.

14. The electrophotogrphic apparatus according to claim 1, wherein said fine resin particles have a triboelectric charge quantity of from −200 μc/g to =50 μc/g.

15. The electrophotographic apparatus according to claim 1, wherein said fine resin particles have a tirboelectric charge quantity of from −100 μc/g to +30 μc/g.

16. The electrophotographic apparatus according to claim 1, wherein said fine resin particles have a specific resistance from $10^6$ Ω·cm to $10^{13}$ Ω·cm.

17. The electrophotographic apparatus according to claim 1, wherein said fine resin particles comprise a styrene resin.

18. The electrophotographic apparatus according to claim 1, wherein said fine resin particles have not less than 51% by weight of styrene monomer units.

19. The electrophotographic apparatus according to claim 1, wherein said fine resin particles have a glass transition point of 80° C. or above.

20. The electrophotogrphic apparatus according to claim 1, wherein said toner has a weight average particle diameter of from 3.5 μm to 20 μm, said fine resin particles have a primary average particle diameter of from 0.03 μ to 1.0 μ, and said fine inorganic powder has a primary average particle diameter of from 0.002 μ to 0.2 μ; the primary average particle diameter of said fine inorganic powder being smaller than the primary average particle diameter of said fine resin particles.

21. The electrophotographic apparatus according to claim 20, wherein said toner phase a weight average particle diameter of from 3.5 μm to 14 μm.

22. The electrophotographic apparatus according to claim 20, wherein said toner has a weight average particle diameter of from 4 μm to 8 μm.

23. The electrophotographic apparatus according to claim 22, wherein said toner comprises toner particles containing a charge control agent.

24. The electrophotographic apparatus according to claim 1, wherein said toner comprises toner particles containing a negative charge control agent represented by the following Formula (I):

Formula (I)

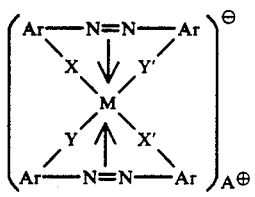

wherein M represents Cr, Co, Ni, Mn or Fe having the coordination number of 6; Ar represents an aryl group which is substituted or unsubstituted; X, X', Y and Y' are the same or different and each represent —O—, —CO—, —NH—or —NR—, where R represents an alkyl group having 1 to 4 carbon atoms; and A⊕ represents a hydrogen ion, a sodium ion, a potassium ion, an ammonium ion or an aliphatic ammonium ion.

25. The electrophotographic apparatus according to claim 1, wherein said toner comprises a toner particles containing a wax having a ratio (Mw/Mn) of weight average molecular weight (Mw) to number average molecular weight (Mn) of not less than 5.

26. The electrophotographic apparatus according to claim 1, wherein said toner comprises toner particles having a binder resin containing not less than 15% of a component with a molecular weight of not more than 5,000 in a GPC chromatogram.

27. The electrophotographic apparatus according to claim 1, wherein said toner comprises toner particles having a binder resin containing from 15% to 35% of a component with a molecular weight of not more than 5,000 in a GPC chromatogram.

28. The electrophotographic apparatus according to claim 27, wherein said toner comprises toner particles having a binder resin comprising a styrene polymer, a styrene copolymer, or a mixture of these.

29. The electrophotographic apparatus according to claim 1, wherein said toner comprises magnetic toner particles.

30. The electrophotographic apparatus according to claim 1, wherein sad toner comprises insulating magnetic toner particles having a negative triboelectric chargeability.

31. An apparatus unit comprising:

an electrostatic image bearing member;

a contact charging member to which a voltage is externally applied, which electrostatically charges said electrostatic image bearing member while being brought into contact with it; and a developing means for developing an electrostatic image thus formed; said developing means comprising a developer carrying member and a developer container that holds therein a developer; said developer comprising a toner, fine resin particles with a surface shape sphericity ψ of from 0.90 to 0.50, and fine inorganic particles;

said contact charging means and said developing means being held as one unit together with said electrostatic image bearing member, and said unit forming a single unit detachably provided in the body of an electrophotographic apparatus.

32. The apparatus unit according to claim 31, wherein said electrostatic image bearing member has an OPC photosensitive layer.

33. The apparatus unit according to claim 31, wherein said contact charging member is roller-shaped.

34. The apparatus unit according to claim 33, wherein said contact charging member has a release film surface layer.

35. The apparatus unit according to claim 31, wherein said contact charging member is blade-shaped.

36. The apparatus unit according to claim 31, wherein said electrostatic image bearing member is provided with a cleaning means for cleaning a toner remaining on its surface.

37. The apparatus unit according to claim 36, wherein said cleaning means has a cleaning blade.

38. The apparatus unit according to claim 31, wherein said fine resin particles have an average particle diameter smaller than the average particle diameter of said toner and larger than the average particle diameter of said fine inorganic powder.

39. The apparatus unit according to claim 31, wherein said fine resin particles have a primary average particle diameter of from 0.03 μ to 1.0 μ.

40. The apparatus unit according to claim 31, wherein said fine resin particles have a primary average particle diameter of from 0.05 μ to 0.8 μ.

41. The apparatus unit according to claim 31, wherein said fine resin particles have a triboelectric charge quantity of from −200 μc/g to +50 μc/g.

42. The apparatus unit according to claim 31, wherein said fine resin particles have a triboelectric charge quantity of from −100 μc/g to +30 μc/g.

43. The apparatus unit according to claim 31, wherein said fine resin particles have a specific resistance of from $10^6$ Ω·cm to $10^{13}$ Ω·cm.

44. The apparatus unit according to claim 31, wherein said fine resin particles comprise a styrene resin.

45. The apparatus unit according to claim 31, wherein said fine resin particles have not less than 51% by weight of styrene monomer units.

46. The apparatus unit according to claim 31, wherein said fine resin particles have a glass transition point of 80° C. or above.

47. The apparatus unit according to claim 31, wherein said toner has a weight average particle diameter of from 3.5 μm to 20 μm, said fine resin particles have a primary average particle diameter of from 0.03 μ to 1.0 μ, and said fine inorganic powder has a primary average particle diameter of from 0.002 μ to 0.2 μ; the primary average particle diameter of said fine inorganic powder being smaller than the primary average particle diameter of said fine resin particles.

48. The apparatus unit according to claim 47, wherein said toner has a weight average particle diameter of from 3.5 μm to 14μm.

49. The apparatus unit according to claim 47, wherein said toner has a weight average particle diameter of from 4 μm to 8 μ.

50. The apparatus unit according to claim 49, wherein said toner comprises toner particles containing a charge control agent.

51. The apparatus unit according to claim 49, wherein said toner comprises toner particles containing a negative charge control agent represented by the following Formula (I):

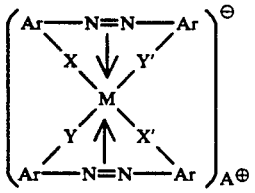

wherein M represents Cr, Co, Ni, Mn or Fe having the coordination number of 6; Ar represents an aryl group which is substituted or unsubstituted; X, X', Y and Y' are the same or different and each represent —O—, —CO—, —NH—or —NR—, where R represents an alkyl group having 1 to 4 carbon atoms; and A⊕ represents a hydrogen ion, a sodium ion, a potassium ion, an ammonium or an aliphatic ammonium ion.

52. The apparatus unit according to claim 31, wherein said toner comprises toner particles containing a wax having a ratio (Mw/Mn) of weight average molecular weight (Mw) to number average molecular weight (Mn) of not less than 5.

53. The apparatus unit according to claim 31, wherein said toner comprises toner particles having a binder resin containing not less than 15% of a component with a molecular weight of not more than 5,000 in a GPC chromatogram.

54. The apparatus unit according to claim 31, wherein said toner comprises toner particles having a binder resin containing from 15% to 35% of a component with a molecular weight of not more than 5,000 in a GPC chromatogram.

55. The apparatus unit according to claim 54, wherein said toner comprises toner particles having a binder resin comprising a styrene polymer, a styrene copolymer, or a mixture of these.

56. The apparatus unit according to claim 31, wherein said toner comprises magnetic toner particles.

57. The apparatus unit according to claim 31, wherein said toner comprises insulating magnetic toner particles having a negative triboelectric chargeability.

58. A facsimile apparatus comprising an electrophotographic apparatus and a receiver means for receiving image information from a remote terminal;

said electrophotographic apparatus comprising:

an electrostatic image bearing member;

a contact charging member to which a voltage is externally applied, which electrostatically charges said electrostatic image bearing member while being brought into contact with it;

an electrostatic image forming means for forming an electrostatic image on the charged electrostatic image bearing member;

a developing means for developing the electrostatic image thus formed; said developing means comprising a developer carrying member and a developer container that holds therein a developer; said developer comprising a toner, fine resin particles with a surface shape sphericity ψ of from 0.90 to 0.50, and fine inorganic particles; and a transfer means for transferring the toner image formed on said electrostatic image bearing member to a transfer medium.

59. The facsimile apparatus according to claim 58, wherein said electrostatic image bearing member has an OPC photosensitive layer.

60. The facsimile apparatus according to claim 58, wherein said contact charging member is connected with a voltage applying means for applying a direct current voltage.

61. The facsimile apparatus according to claim 58, wherein said contact charging member is connected with a voltage applying means for applying an alternating current voltage.

62. The facsimile apparatus according to claim 58, wherein said contact charging member is connected with a voltage applying means for applying a direct current voltage overlaid with an alternating current voltage.

63. The facsimile apparatus according to claim 58, wherein said contact charging member is roller-shaped.

64. The facsimile apparatus according to claim 63, wherein said contact charging member has a release film surface layer.

65. The facsimile apparatus according to claim 58, wherein said contact charging member is blade-shaped.

66. The facsimile apparatus according to claim 58, wherein said electrostatic image bearing member is provided with a cleaning means for cleaning a toner remaining after transfer.

67. The facsimile apparatus according to claim 66, wherein said cleaning means is provided with a cleaning blade.

68. The facsimile apparatus according to claim 58, wherein said fine resin particles have an average particle diameter smaller than the average particle diameter of said toner and larger than the average particle diameter of said fine inorganic powder.

69. The facsimile apparatus according to claim 58, wherein said fine resin particles have a primary average particle diameter of from 0.03 μ to 1.0 μ.

70. The facsimile apparatus according to claim 58, wherein said fine resin particles have a primary average particle diameter of from 0.05 μ to 0.8 μ.

71. The facsimile apparatus according to claim 58, wherein said fine resin particles have a triboelectric charge quantity of from −200 μc/g to +50 μc/g.

72. The facsimile apparatus according to claim 58, wherein said fine resin particles have a triboelectric charge quantity of from −100 μc/g to +30 μc/g.

73. The facsimile apparatus according to claim 58, wherein said fine resin particles have a specific resistance of from $10^6$ Ω·cm to $10^{13}$ Ω·cm.

74. The facsimile apparatus according to claim 58, wherein said fine resin particles comprise a styrene resin.

75. The facsimile apparatus according to claim 58, wherein said fine resin particles have not less than 51% by weight of styrene monomer units.

76. The facsimile apparatus according to claim 58, wherein said fine resin particles have a glass transition point of 802 C. or above.

77. The facsimile apparatus according to claim 58, wherein said toner has a weight average particle diameter of from 3.5 μm to 20 μm, said fine resin particles have a primary average particle diameter of from 0.03 μ to 1.0 μ, and said fine inorganic powder has a primary average particle diameter of from 0.002 μ to 0.2 μ; the primary average particle diameter of said fine inorganic powder being smaller than the primary average particle diameter of said fine resin particles.

78. The facsimile apparatus according to claim 77, wherein said toner has a weight average particle diameter of from 3.5 μm to 14 μm.

79. The facsimile apparatus according to claim 77, wherein said toner has a weight average particle diameter of from 4 μm to 8 μm.

80. The facsimile apparatus according to claim 79, wherein said toner comprises toner particles containing a charge control agent.

81. The facsimile apparatus according to claim 58, wherein said toner comprises toner particles containing a negative charge control agent represented by the following Formula (I):

Formula (I)

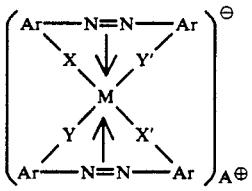

wherein M represents Cr, Co, Ni, Mn or Fe having the coordination number of 6; Ar represents an aryl group which is substituted or unsubstituted; X, X', Y and Y' are the same or different and each represent —O—, —CO—, —NH—or —NR—, where R represents an alkyl group having 1 to 4 carbon atoms; and A⊕ represents a hydrogen ion, a sodium ion, a potassium ion, an ammonium ion or an aliphatic ammonium ion.

82. The facsimile apparatus according to claim 58, wherein sad toner comprises toner particles containing a wax having a ratio (Mw/Mn) of weight average molecular weight (Mw) to number average molecular weight (Mn) of not less than 5.

83. The facsimile apparatus according to claim 58, wherein sad toner comprises toner particles having a binder resin containing not less than 15% of a component with a molecular weight of not more than 5,000 in a GPC chromatogram.

84. The facsimile apparatus according to claim 58, wherein said toner comprises toner particles having a binder resin containing from 15% to 35% of a component with a molecular weight of not more than 5,000 in a GPC chromatogram.

85. The facsimile apparatus according to claim 84, wherein said toner comprises toner particles having a binder resin comprising a styrene polymer, a styrene copolymer, or a mixture of these.

86. The facsimile apparatus according to claim 58, wherein said toner comprises magnetic toner particles.

87. The facsimile apparatus according to claim 58, wherein said toner comprises insulating magnetic toner particles having a negative triboelectric chargeability.

* * * * *

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 1

Line 18, "eIectrostatic" should read --electrostatic--.
Line 66, "then" should read --when--.

COLUMN 2

Line 1, "event" should read --agent--.
Line 4, "to cause" should read --which causes--.
Line 6, "member)" should read --member).--.
Line 7, "either," should read --either--.
Line 45, "&he" should read --the--.

COLUMN 3

Line 42, "the, and" should be deleted.
Line 51, "chargeabiity" should read --chargeability--.
Line 58, "adhers" should read --adheres--.
Line 61, "&o" should read --to--.

COLUMN 4

Line 10, "come" should read --become--.
Line 29, "severer." should read --more severe.--.
Line 47, "with" should read --with the--.
Line 48, "with" should read --to--.
Line 49, "are" should read --area--.
Line 50, "a" should be deleted.
Line 66, "e" should read --a--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 5

Line 1, "hand," should read --other hand,--.
Line 32, "&he" should read --the--.
Line 39, "eleotrostatic" should read --electrostatic--.
Line 52, "eleotrostatic" should read --electrostatic--.

COLUMN 6

Line 1, "no" should read --lack of--.
Line 6, "electrostatic" should read --electrostatic--.
Line 8, "fluidity and" should read --fluidity-- and "cause" should read --causes--.
Line 23, "a" should read --an--.
Line 31, "from" should read --form--.
Line 42, "prevented" should read --prevents--.
Line 47, "end" should be deleted.
Line 49, "fecsimile" should read --facsimile--.
Line 56, "of;" should read --of:--.
Line 58, "con&ac& wi&h" should read --contact with--.

COLUMN 7

Line 5, "comprising;" should read --comprising:--.
Line 31, "end" should read --and--.
Line 36, "e" should read --a--.
Line 40, "end" should read --and--.
Line 49, "comprising;" should read --comprising:--.
Line 50, "member:" should read --member;--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 8

Line 9, "illustration" should read --illustrations--.
Line 30, "why" should be deleted.
Line 35, "is" should read --is;--.
Line 40, "parts" should read --part at--.
Line 45, "g" should be deleted.
Line 63, "sphericity" should read --sphericity $\psi$--.

COLUMN 9

Line 5, "&he" should read --the--.
Line 12, "&he" should read --the--.
Line 67, "many" should read --may--.

COLUMN 10

Line 3, "&he" should read --the--.
Line 20, "hand" should read --hand,--.
Line 55, "asture" should read --as true--.
Line 58, "volume (4/3 $\pi^3$)" should read --volume ($4/3\pi r^3$)--.

COLUMN 11

Line 10, "Next" should read --Next,--.
Line 25, "cepacitor," should read --capacitor,--.
Line 26, "&he" should read --the--.
Line 28, "this" should read --these--.
Line 55, "form" should read --from--.
Line 66, "acrlic" should read --acrylic--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 12

Line 19, "toner" should read --toner.--.
Line 39, "end" should read --and--.
Line 52, "logering" should read --lowering--.

COLUMN 13

Line 15, "foged" should read --fumed--.
Line 17, "get" should read --wet-- and
"lass" should read --glass--.
Line 25, "siIicon" should read --silicon--.
Line 31, "parities" should read --particle--.
Line 54, "elkoxyl" should read --alkoxyl--.

COLUMN 14

Line 13, "of these" should read --of the same--.
Line 25, "end" should read --and--.
Line 32, "Image bearing-member," should read
--image bearing member,--.
Line 38, "coarse," should read --course,--.
Line 42, "100" should read --100 ml--.
Line 51, "gavelength" should read --wavelength--.
Line 62, "greater" should read --water--.

COLUMN 15

Line 3, "&he" should read --the--.
Line 12, "excellent" should read --excellent--.
Line 19, "e" should read --a--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 16

Line 53, "$H^{+}$" should read --$H^{\bullet}$--.

COLUMN 17

Line 55, "&he" should read --the--.

COLUMN 18

Line 5, "methaorylate," should read --methacrylate,--.
Line 6, "ethylene. polypropylene" should read --ethylene, polypropylene,--.
Line 9, "petroIeum" should read --petroleum-- and "pareffin" should read --paraffin--.
Line 44, "littIe" should read --little--.

COLUMN 19

Line 2, "tetrahydro-" should read --(tetrahydro- --.
Line 5, "&hereinto" should read --thereinto--.
Line 24, "G5000H($H_{x1}$)," should read --G5000H($H_{xL}$),--.
Line 30, "become" should read --becomes--.
Line 37, "&he" should read --the--.
Line 58, "magnetic," should read --magnetite,--.
Line 60, "cobal," should read --cobalt,--.

COLUMN 20

Line 17, "unable" should read --usable--.
Line 20, "yellow," should read --Yellow,--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 20

Line 21, "yellow," should read --Yellow,-- and "Lake" (first occurrence) should read --Lake,--.
Line 22, "Phthalooyanine" should read --Phthalocyanine--.
Line 30, "anthrequinone" should read --anthraquinone--.
Line 40, "gases," should read --waxes,--.
Line 54, "end" should read --and--.
Line 61, "gases" should read --waxes--.
Line 67, "&o" should read --to--.

COLUMN 21

Line 40, "component&" should read --component--.
Line 42, "end" should read --and--.

COLUMN 22

Line 14, "end" should read --and--.
Line 15, "wi&h" should read --with--.
Line 25, "o" should read --a--.

COLUMN 23

Line 6, "e" should read --a--.
Line 15, "then" should read --when--.

COLUMN 24

Line 5, "eleotrophotographic" should read --electrophotographic--.
Line 25, "electrostaticallV" should read --electrostatically--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 24

Line 39, "is" should read --are--.
Line 42, "When" should read --when--.
Line 52, "&he" should read --the--.
Line 56, "state" should read --state.--.
Line 62, "the the" should read --the--.
Line 68, "oner" should read --toner--.

COLUMN 25

Line 4, "&his" should read --this--.
Line 12, "means 501," should read --means 512,--.
Line 21, "doc&or" should read --doctor--.
Line 40, "&he" should read --the--.
Line 42, "±he" should read --the--.
Line 66, "&he" should read --the--.

COLUMN 26

Line 40, "gas" should read --was--.
Line 42, "&he" should read --the--.

COLUMN 27

Line 6, "end" should read --and--.
Line 17, "e" should read --a--.
Line 20, "log" should read --low--.
Line 38, "in&o" should read --into--.
Line 42, "gas" should read --was--.

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 28

Line 13, "Do&" should read --Dot-- and
"wi&h" should read --with--.
Line 14, "&he" should read --the--.
Line 25, "0.6" should read --0.5--.
Line 26, "-26" should read -- -25--.

COLUMN 29

Line 30, "cooled." should read --cooled,--.
Line 61, "gas" should read --was--.

COLUMN 30

Line 17, "gas" should read --was--.
Line 19, "gas" should read --was--.
Line 33, "&he" should read --the--.

COLUMN 31

Line 7, "gas" should read --was--.
Line 20, "gas" should read --was--.
Line 37, "toner" should read --toner formation--.
Line 47, "Hauschel" should read --Henschel--.

COLUMN 32

Line 24, "an an" should read --an--.
Line 34, "width:" should read --(width:--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 33

Line 15, "aorylate" should read --acrylate--.
Line 22, "cooled" should read --cooled,--.
Line 36, "Negetive" should read --Negative--.
Line 38 should be deleted.

COLUMN 34

TABLE 7, "sphericity" should read --Sphericity--.

COLUMN 35

TABLE 7-continued, "sphericity" should read --Sphericity--.
Line 41, "comprising;" should read --comprising:--.

COLUMN 36

Line 16, "vol&age" should read --voltage--.
Line 45, "electrophotogrphic" should read --electrophotographic--.
Line 47, "=50" should read --+50--.
Line 50, "tirboe-" should read --triboelectric--.
Line 51, "lectric" should be deleted.
Line 65, "electrophotogrphic" should read --electrophotographic--.

COLUMN 37

Line 7, "phase" should read --has--.
Line 38, "a" should be deleted.
Line 60, "sad" should read --said--.

--

UNITED STATES PATENT AND TRADEMARK OFFICE

CERTIFICATE OF CORRECTION

PATENT NO. : 5,319,424

DATED : June 7, 1994

INVENTOR(S) : KOICHI TOMIYAMA, ET AL.

It is certified that error appears in the above-identified patent and that said Letters Patent is hereby corrected as shown below:

COLUMN 39

Line 3, "8 μ." should read --8 μm.--.
Line 9, "following" should read --following Formula (I):--.
Line 28, "ammonium" (first occurrence) should read --ammonium ion--.

COLUMN 40

Line 66, "802 C." should read --80°C.--.

COLUMN 42

Line 8, "sad" should read --said--.
Line 13, "sad" should read --said--.

Signed and Sealed this

First Day of November, 1994

Bruce Lehman

*Attest:*

*Attesting Officer*

BRUCE LEHMAN

*Commissioner of Patents and Trademarks*

--